US011149433B1

(12) United States Patent
Rulon

(10) Patent No.: US 11,149,433 B1
(45) Date of Patent: Oct. 19, 2021

(54) MODULAR BUILDING BLOCKS AND BUILDING SYSTEM

(71) Applicant: John David Rulon, Los Altos, CA (US)

(72) Inventor: John David Rulon, Rutherford, CA (US)

( * ) Notice: Subject to any disclaimer, the term of this patent is extended or adjusted under 35 U.S.C. 154(b) by 0 days.

(21) Appl. No.: 16/709,830

(22) Filed: Dec. 10, 2019

Related U.S. Application Data

(63) Continuation of application No. 16/052,197, filed on Aug. 1, 2018, now Pat. No. 10,501,932.

(51) Int. Cl.
*E04B 2/18* (2006.01)
*E04B 5/00* (2006.01)
*E04B 2/02* (2006.01)

(52) U.S. Cl.
CPC ..... *E04B 2/18* (2013.01); *E04C 1/24* (2013.01); *E04B 2002/0217* (2013.01); *E04B 2002/0265* (2013.01)

(58) Field of Classification Search
None
See application file for complete search history.

(56) References Cited

U.S. PATENT DOCUMENTS 1,685,353 A * 9/1928 Frease ..... E04C 3/09 52/634
2,158,412 A * 5/1939 Emery ..... E04B 2/42 52/279
2,176,986 A * 10/1939 Briscoe ..... E04B 2/42 52/293.2
2,184,137 A * 12/1939 Brewer ..... E04B 5/08 52/223.7
2,619,829 A 12/1952 Tatum
3,239,982 A * 3/1966 Nicosia ..... E04C 2/22 52/309.7
4,223,053 A * 9/1980 Brogan ..... B29D 24/008 428/34.5
5,428,933 A * 7/1995 Philippe ..... E04B 2/54 464/124
5,596,853 A 1/1997 Blaney et al.
5,615,529 A * 4/1997 Johnson ..... A01G 9/28 52/604
6,280,121 B1 * 8/2001 Khamis ..... E02D 29/0225 405/284
6,401,419 B1 * 6/2002 Beliveau ..... E04B 2/8617 52/309.12
6,513,293 B2 2/2003 Miller
7,669,384 B2 * 3/2010 Kaida ..... B21C 33/004 52/790.1

(Continued)

*Primary Examiner* — Joshua K Ihezie

(57) ABSTRACT

Devices, structures, and methods for designing, constructing, and fitting modular structural building blocks together into a unified structure. Modular blocks are rapidly fit together into finished assemblies. Finished assemblies include reinforcing elements aligned in a structurally sound pattern. The unified structure includes walls, provisions for corners, and provisions for door/window spaces. The unified structure optionally includes raised floors or lowered ceilings, offset from ordinary associated height, using blocks disposed side-by-side with intermediate supports. The unified structure optionally includes one or more curved structures, such as vaulted ceilings, rounded walls or silos, tunnels, or otherwise.

20 Claims, 26 Drawing Sheets

(56) References Cited

U.S. PATENT DOCUMENTS

| | | | | |
|---|---|---|---|---|
| 8,291,669 | B2 * | 10/2012 | Karau | E04C 1/395 52/609 |
| 8,646,239 | B2 * | 2/2014 | Rulon | E04B 2/50 52/606 |
| 9,523,201 | B2 * | 12/2016 | Romanenko | E04C 1/397 |
| 2001/0025462 | A1 * | 10/2001 | Laurent | B62D 29/001 52/426 |
| 2007/0227086 | A1 * | 10/2007 | Beavers | E04B 1/80 52/309.7 |
| 2009/0193740 | A1 * | 8/2009 | Bennett | E04C 1/40 52/309.1 |
| 2012/0031031 | A1 * | 2/2012 | Rulon | E04B 2/50 52/503 |
| 2016/0002918 | A1 * | 1/2016 | Conturo | E04B 2/48 52/604 |
| 2016/0076246 | A1 * | 3/2016 | Romanenko | E04B 2/36 52/204.1 |

* cited by examiner

Block 100

Block 100
131L
140L
131
110
133
130
111b
132
131b
111a
131a

Structure 150
151a
100
140R
140L
151b
100

Structure 160

Structure 160
162b

Block 200
110
120
201
202

Block 200
201
110

Block 200

Block 200
201
202a
202b
210

Block 200
220

Block 230
231a
231b

Structure 150

Block 300
320
340R
310
333
332
330
311b
311a
331a
331b
340L

Structure 350
333
340L
340R
351
351

Block 300
310
320

Block 300
311a
311b
310
331L
330
331
320
332

Block 380b

Structure 370a
372b
371a
372b

Structure 370

Structure 410

Structure 410

Structure 410

Structure 410

Bond beam
Lintel
Standard
100
Base
520
Template
510

Bond beam
Standard
100
Lintel
Template
510
Base
520

MODULAR BUILDING BLOCKS AND BUILDING SYSTEM

INCORPORATED DISCLOSURES

Incorporated Documents

Techniques described in this application can be used with ideas described in the following document:

U.S. Pat. No. 8,646,239 B2, filed Aug. 3, 2011, issued Feb. 11, 2014, in the name of John David RULON, titled "Modular building block and building system".

This document is hereby incorporated by reference as if fully set forth herein. Techniques described in this application can be elaborated with detail found therein.

BACKGROUND

Field of the Disclosure

This Application generally describes techniques relating to modular building blocks, and structures built using modular building blocks.

Related Art

As described in the Incorporated Documents, there is a need for a structural construction system, which provides a lightweight yet reliably strong building block that can withstand stresses caused from loads and other forces such as seismic activity and weather. A reinforced concrete structure that incurs a reduced transportation cost due to a reduction in weight of the prefabricated blocks and reduced labor costs, which come from installation, would be beneficial. A structural construction system that is pre-engineered to incorporate reinforcement within the block and provide a means to tie each block together with simple standard components would also be beneficial.

While in general, many of these goals can be accomplished using techniques described in the Incorporated Documents, there is further need for structural building blocks that have greater internal strength, and which lend themselves to greater manipulation of thermal mass, fireproofing, pest control, soundproofing, and related building features. There is also further need for structural building blocks that have greater generality of use and modularity. There is also further need for structural building blocks that can be fitted to curved enclosures, and that can be supported by additional supporting elements.

One need for greater modularity manifests when structural blocks are used at corners and with doors and windows. Another need for greater modularity manifests when structural blocks are used for curved structures, including vaults, tanks, and tunnels, particularly when those curved structures meet straight structures. Another need for greater modularity manifests when structural blocks are used at right angles to walls, such as for floors and raised floors. Another need for greater modularity manifests when it is desirable to have only a few types of structural blocks, and for those few types of structural blocks to be as combinable as possible without special selection of alignment or direction.

Each of these issues, as well as other possible considerations, might cause difficulty in aspects of designing, constructing, and fitting modular structural building blocks together. These issues can be of especial concern in aspects of using modular structural building blocks at corners, for doors and windows, for curved structures, or at right angles to an ordinary orientation.

SUMMARY OF THE DISCLOSURE

This Application describes devices, structures, and methods for designing, constructing, and fitting modular structural building blocks together into a unified structure. A set of blocks can be rapidly fit together into finished assemblies. Finished assemblies can include reinforcing elements, such as steel or rebar rods, aligned in a structurally sound triangular pattern.

In one embodiment, the unified structure can include one or more walls, including provisions for corners, and provisions for spaces for doors or windows. The unified structure can also include one or more floors/ceilings, which may be offset from their ordinary associated height (thus providing raised floors or lowered ceilings). The unified structure can also include one or more curved structures, such as vaulted ceilings, rounded walls or silos, tunnels, or otherwise.

BRIEF DESCRIPTION OF THE FIGURES

In the figures, like references generally indicate similar elements, although this is not strictly required. This is for simplicity's sake, and does not indicate any necessary relationship between different figures or embodiments described herein.

After reading this application, those skilled in the art would recognize that the figures are not necessarily drawn to scale for construction, nor do they necessarily specify any particular location or order of construction.

DETAILED DESCRIPTION

General Discussion

Specific examples of components, devices including those components, and arrangements or structures including those devices, are further described herein. These specific examples are only exemplary, and are not intended to be limiting in any way.

References in the specification to "one embodiment", "an embodiment", "an example embodiment", etc., indicate that the embodiment described may include a particular feature, structure or characteristic, but every embodiment may not necessarily include the particular feature, structure or characteristic. Moreover, such phrases are not necessarily referring to the same embodiment. Further, when a particular feature, structure or characteristic is described in connection with an embodiment, it is submitted that it is within the knowledge of one of ordinary skill in the art to effect such feature, structure or characteristic in connection with other embodiments whether or not explicitly described. Parts of the description are presented using terminology commonly employed by those of ordinary skill in the art to convey the substance of their work to others of ordinary skill in the art.

Terms and Phrases

The phrase "end condition" (and similar phrases) generally refers to an end or terminal portion of a building block. For example, and without limitation, this phrase can refer to any portion of a building block shaped or otherwise disposed to couple to and structurally complement an adjacent end condition of another building block.

Figures and Text

Interlocking Elements

FIG. 1 (collectively including FIGS. 1A-1E) shows a conceptual drawing of a first example building block, and related components and structures, showing interlocking elements. FIG. 1A shows a top view of an example block. FIG. 1B shows an oblique view of an example block. FIG. 1C shows a side view of an example vertical structure built from multiple blocks. FIG. 1D shows a side view of an example horizontal structure built from multiple blocks. FIG. 1E shows a bottom side view of an example horizontal structure built from multiple blocks.

Figure 1A:
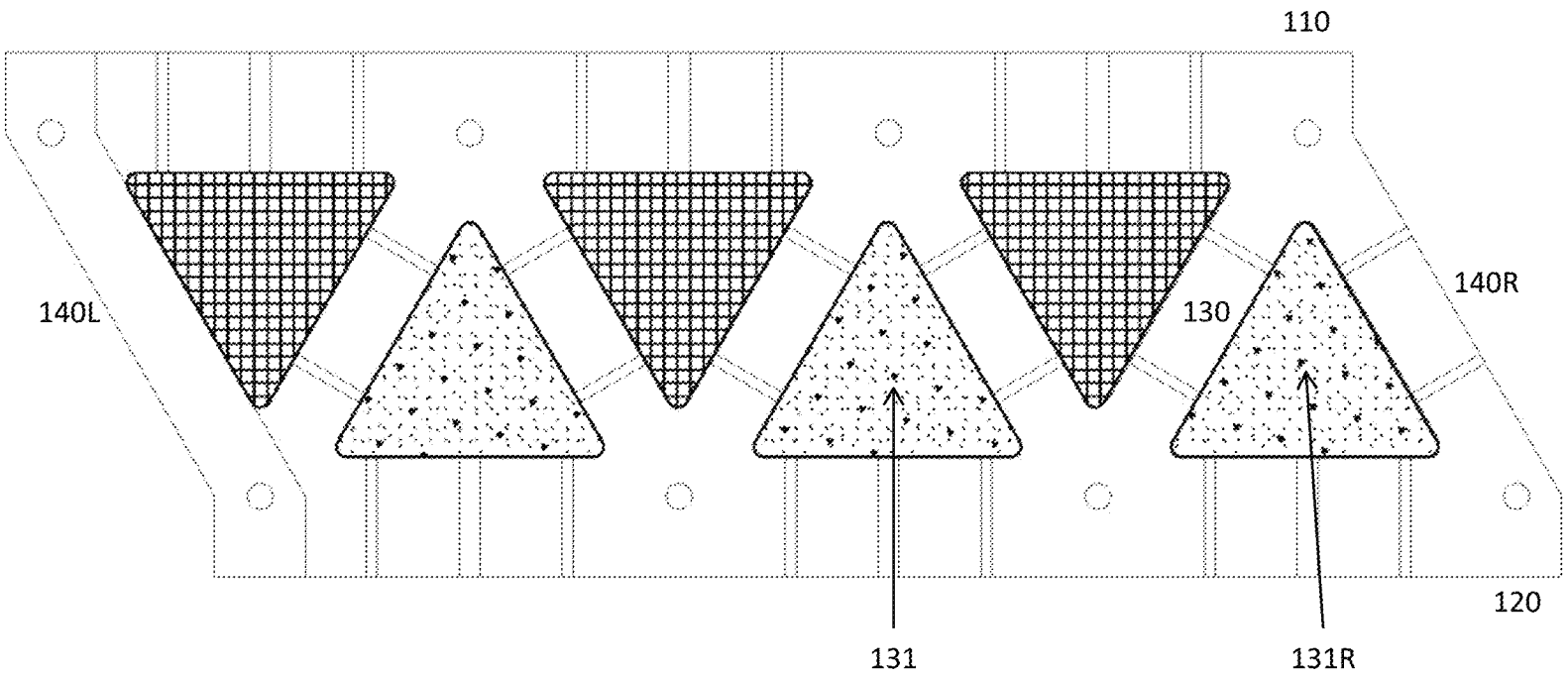
FIG. 1 (collectively including FIGS. 1A-1E) shows conceptual drawings of example building blocks, and related components and structures, showing interlocking elements.
Figure 1B:
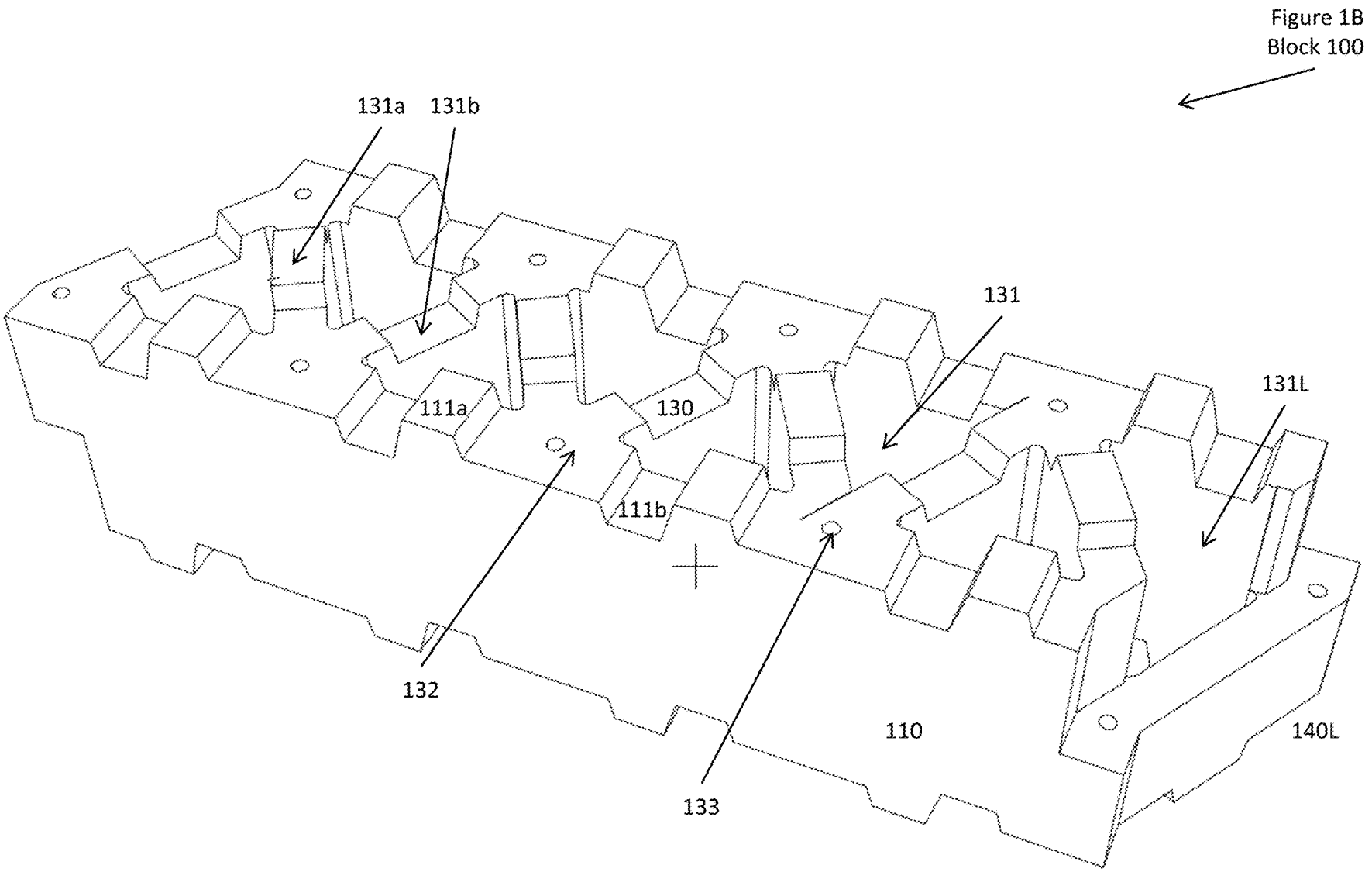
Figure 1C:
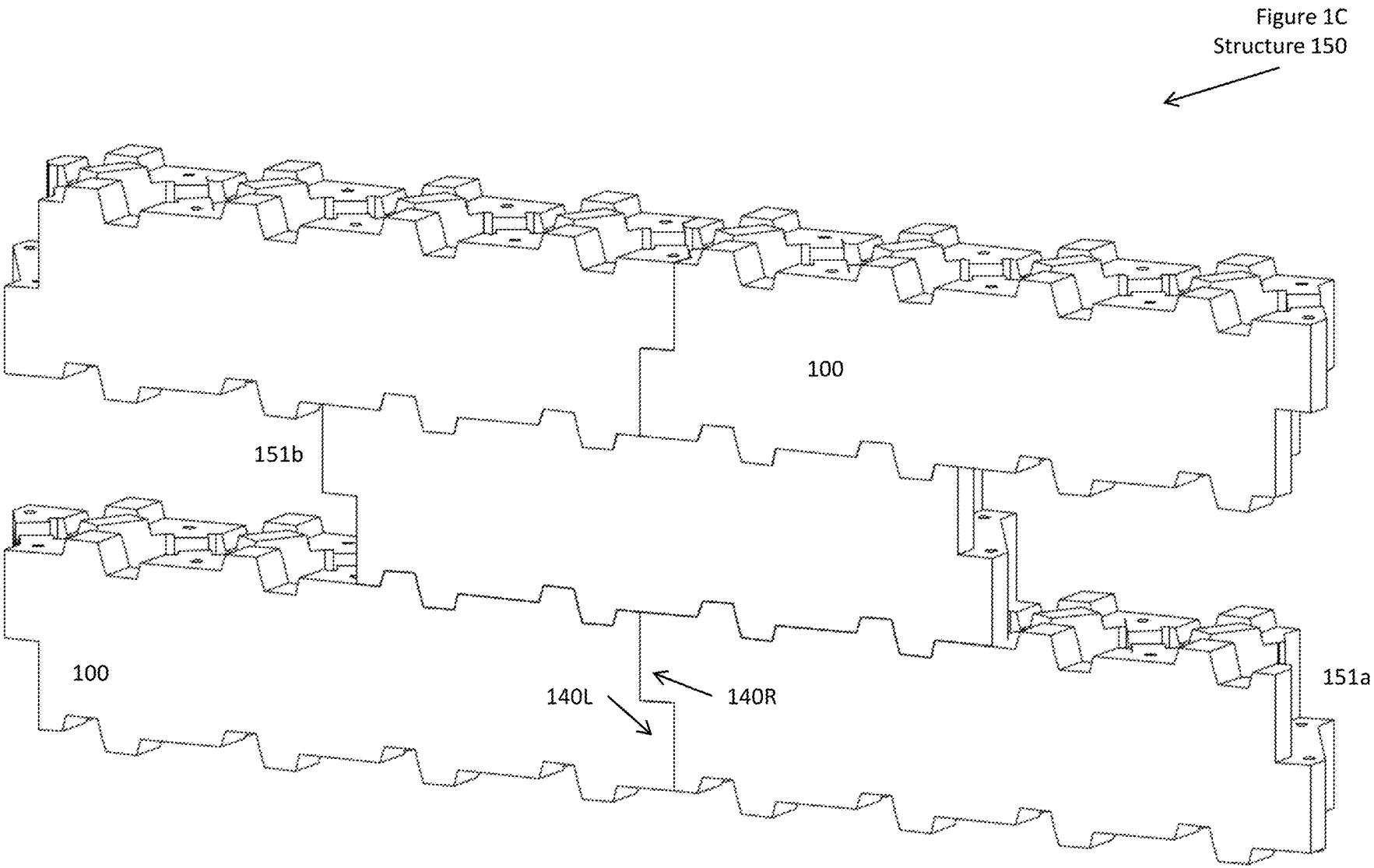
Figure 1D:
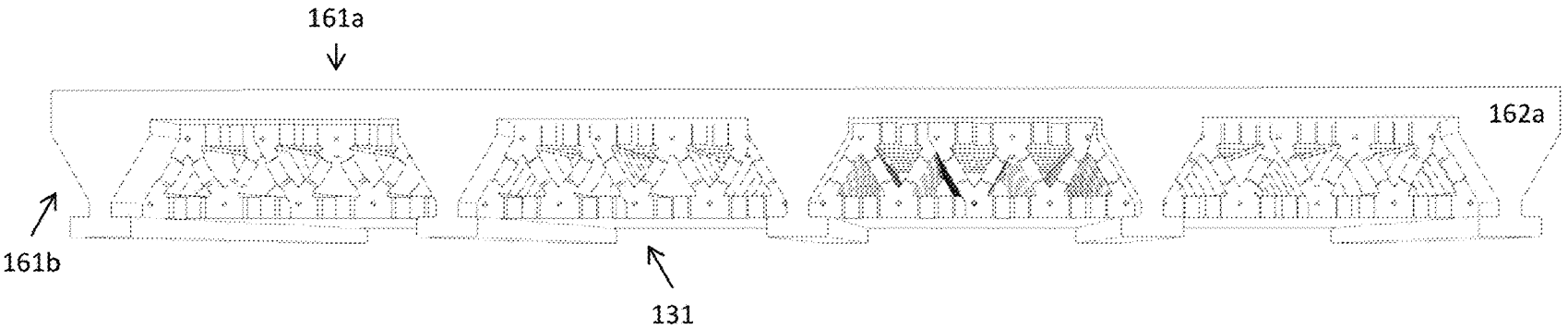
Figure 1E:
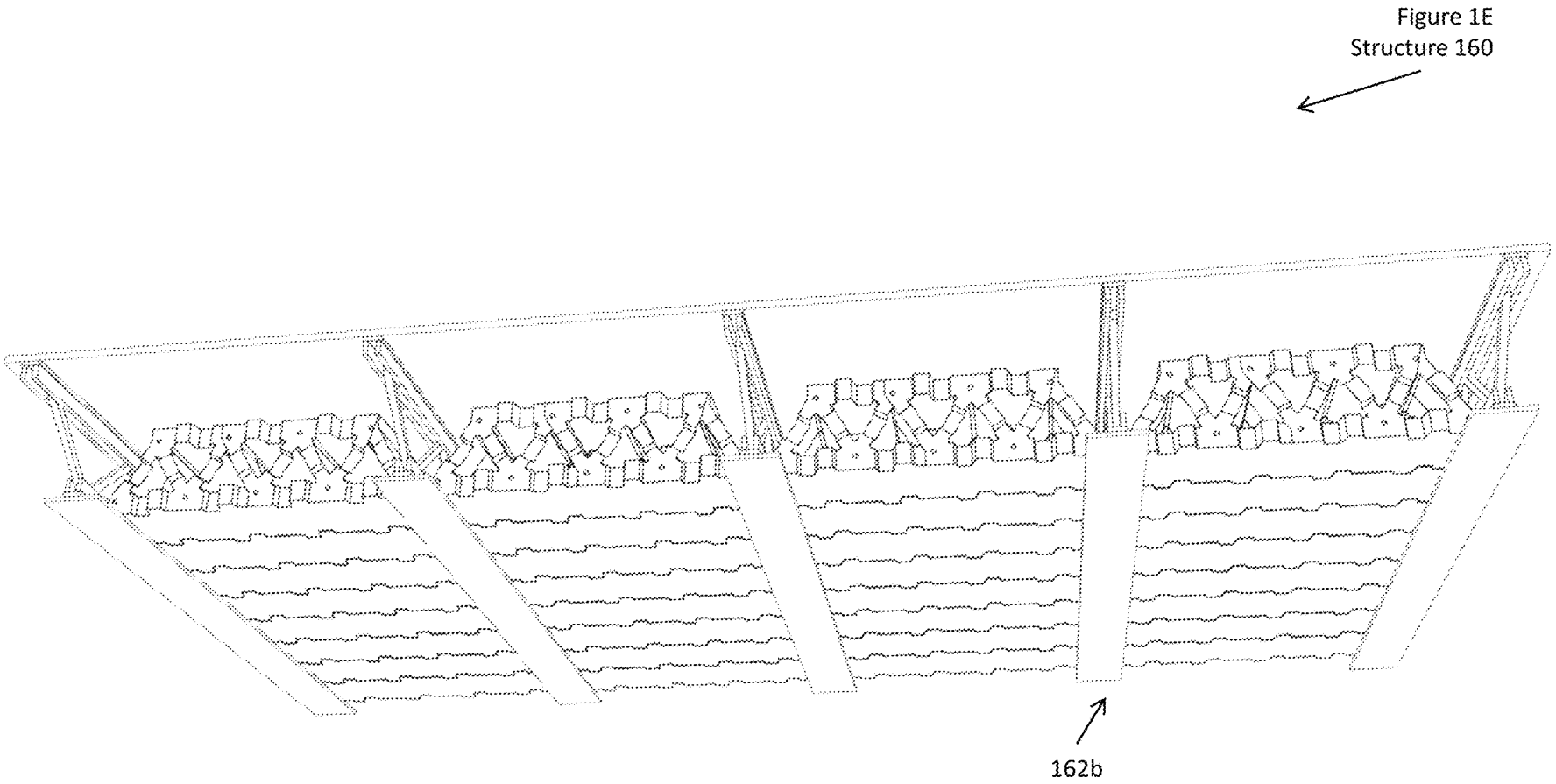

In FIGS. 1D-1E, the structures show raised floor blocks supported by separate beams or trusses. For example, these primary support beams or trusses can be made of steel or concrete, not part of the blocks themselves. In one embodiment, the blocks used in FIGS. 1D-1E (coupled side to side) are also shown in similar blocks in FIG. 5C (coupled top to bottom, and laid on their sides). These similar blocks differ in having end conditions without a stepped end; they do not necessarily link to adjacent blocks at either end. In one embodiment, these similar blocks have an odd number of internal elements 131, so as to have a trapezoidal shape when viewed from the side.

In one embodiment, modular blocks each include two walls, an iterable interlocking triangular element disposed between the two walls, and one or more end conditions. For example, each block includes a selected number of interlocking triangular elements (such as 2, 4, 6, 8, 10, 12, any other even number, or otherwise). The interlocking elements are disposed with matching protrusions/recesses with the effect that each block fits into a substantially rigid structure when its protrusions/recesses match those of other blocks. The matching protrusions/recesses are disposed so that rotations of a block about X (lateral), Y (depth), or Z (height) axes, still leave the blocks' protrusions/recesses with the ability to fit together. In one embodiment, the interlocking triangular elements should line up when matching protrusions/recesses line up.

As further described herein, in another embodiment the modular blocks can each include odd numbers (such as 3, 5, 7, any other odd number, or otherwise) of interlocking triangular elements. These modular blocks including odd numbers of interlocking triangular elements can be used to change the end condition angle.

The protrusions/recesses are disposed so that each block fits into a substantially rigid structure when it is substantially offset from the blocks with which it is matched. This has the effect that blocks can be disposed in a substantially rigid structure that is also without substantial vertical weaknesses (or horizontal weaknesses in the case of floors/ceilings) so that portions of the wall do not require extensive support to remain freestanding. In one embodiment, vertical reinforcing rods, or other reinforcing structures, can be disposed through the holes 133, with the effect of providing tensional strength at times the wall is subject to bending, such as from seismic activity, weather, and other harmful factors. For example, the vertical reinforcing rods can extend the height of a wall made from the modular blocks, with the effect of reinforcing a wall structure. In one embodiment, at the top of a wall made from the modular blocks, the blocks at the top can be substantially flat, to allow for beams or trusses to sit on top of these bond beams, instead of including modular protrusions/recesses.

In one embodiment, the triangular elements and the walls include, at selected locations, such as where the triangular elements meet the walls, holes into which vertical supports, in the case of vertical walls, or horizontal supports, in the case of horizontal structures such as ceilings or floors, can be inserted. The horizontal supports or vertical supports can include rods, such as made of steel or rebar. The horizontal supports or vertical supports can include pipes, such as made of metal or a plastic such as PVC. Other durable coupling elements are also possible. Other means to effect support against external forces, such as seismic activity, weather, and other harmful factors.

As further described above, the vertical reinforcing rods, or other reinforcing structures, can be disposed through the holes 133, with the effect of providing tensional strength at times the wall is subject to stress. In one embodiment, the vertical reinforcing rods can include a base (not shown in this figure) including a threaded coupler, to couple to rebar (or other support structures). Similarly, in another embodiment, the vertical reinforcing rods can include threading and a nut at a top end (not shown in this figure), with the effect that one or more vertical reinforcing rods can be post tensioned by tightening the nut.

After reviewing this application, those skilled in the art would recognize that the vertical reinforcing rods, when disposed at the locations described herein, can have the effect of providing a relatively maximum moment of inertia for a wall composed of multiple such modular blocks. In one embodiment, this can have the effect of providing a relatively greatest effect in providing structural strength and support. In one embodiment, not all holes disposed for vertical reinforcing rods need be used. The number and spacing of vertical reinforcing rods can be selected in response to local conditions, as further described herein.

In one embodiment, spacing of the holes on each side of the block can be 8" on center. However, other distances, such as 16", 24", 32", 40", 48", otherwise, can be used in response to architectural or structural desires. After reviewing this application, those skilled in the art would recognize that the vertical reinforcing rods can include one or more of the following: basalt fiber, carbon fiber, fiberglass, steel, or other materials that are strong in tension. For example, vertical reinforcing rods can include steel or stainless steel, noncorrosive materials, or other materials.

In one embodiment, when a horizontal structure is built from multiple blocks disposed side by side, those multiple blocks can be disposed with a support structure holding them together and supporting them. For example, the support structure can include one or more support elements. Each support element can include a setting 162*a* (such as a concrete filler) and/or a support 162*b* (such as one or more steel or concrete bars). In one embodiment, one or more cross-supports (not shown) can be coupled to the settings and/or the supports, such as in a support structure coupled to the blocks (not shown). The cross-supports can include steel or concrete bars placed at right angles, or another angle, to the settings or supports, such as in support structures with cross-supports used for supporting building structures.

Example Building Block

FIG. 1A shows a top view of an example building block. FIG. 1B shows an oblique view of an example building block.

A first example building block 100 includes a first wall 110, a second wall 120, and one or more internal dividers 130. The internal dividers 130 define one or more internal elements 131, which can be disposed as equilateral triangles defining voids (or defining regions that can be filled with one or more materials, as further described herein). For example, the internal elements 131 can be filled with structural, insulative, or thermal materials as further described herein. The internal elements 131 are iterated between the first wall 110 and the second wall 120, with the effect that the first wall 110 and the second wall 120 can have multiple internal elements 131 disposed between them. When those internal elements 131 are equilateral triangles, they are disposed in alternating up/down (as viewed from above) or in/out (as viewed from a side) directions. In one embodiment, each block 100 includes an even number of such internal elements 131, thus, a whole number of pairs of alternating up/down equilateral triangles. As further described herein, in another embodiment, at least some blocks 100 can include an odd number of such internal elements 131, thus, a whole number of pairs with an extra equilateral triangle, with the effect of providing blocks 100 with a substantially trapezoidal shape.

A right-hand end-piece 140R is defined by a right-hand side 131R of a right-hand internal element 131. A left-hand end-piece 140L is defined by a left-hand side 131L of a left-hand internal element 131. The right-hand end-piece 140R includes a upward pointing triangle disposed over an empty space, while the left-hand end-piece 140L includes an downward pointing triangle disposed under an empty space.

In one embodiment, the block 100 is substantially symmetrical with respect to rotations about X (lateral), Y (depth), and Z (height) axes. This has the effect that the block 100 can be picked up and placed at many distinct locations, so long as the modular elements match, with at most one or two requirements to rotate/flip the block 100. Even though the blocks 100 can be made of an aerated concrete, such as cellular lightweight concrete, or another lightweight rigid substance, they can be relatively heavy when lifted by hand, so it is desirable that they are not subject to overly many manipulations that might result in them being misplaced or dropped.

The first wall 110 and second wall 120 each define one or more wall protrusions 111*a* and wall recesses 111*b*. On each of the first wall 110 and the second wall 120, the wall protrusions 111*a* alternate with wall recesses 111*b*. This has the effects that: (a) each block 100 fits on top of a block 100 it rests upon, (b) each block 100 is prevented from sliding along the top of the block 100 it rests upon, and (c) each block 100 is required to be offset from the block 100 it rests upon, by an amount approximately equal to one side of an internal element 131.

The internal dividers 130 each define one or more internal protrusions 131*a* or internal recesses 131*b*. On the internal dividers 130, the internal protrusions 131*a* alternate with internal recesses 131*b*. This similarly has the effects that: (a) each block 100 fits on top of a block 100 it rests upon, (b) each block 100 is prevented from sliding along the top of the block 100 it rests upon, and (c) each block 100 is required to be offset from the block 100 it rests upon, by an amount approximately equal to one side of an internal element 131. Thus, the offset should be about 8", a distance between holes 133, or multiples thereof, with the effect of providing a "running bond". Alternatively, each block 100 need not be offset from the block 100 it rests upon, instead being stacked directly above, with the effect of providing a "stacked bond".

The internal dividers 130 also define one or more landings 132, where the internal dividers 130 meet the first wall 110 and the second wall 120. At these locations, the first wall 110 and the second wall 120 are at their level height without wall protrusions 111*a* or wall recesses 111*b*. Each landing 132 includes a through hole 133, through which a tension rod can be disposed. A tension rod can be made of steel or other tensile material.

In one embodiment, when each internal element 131 includes an equilateral triangle, the support rods can be disposed in a triangular (or possibly hexagonal) grid, with each support rod located substantially near 5 other such support rods (except near ends of the grid). The support rods can be coupled to a support structure, such as including a grid of cross-support rods, at selected heights of the wall, with the effect that the support rods are further able to resist displacement of the blocks 100 in any direction. This can have the effect of strengthening any structure built from the blocks 100, such as a vertical structure 150 or a horizontal structure 160 as further described herein.

Vertical Structure

FIG. 1C shows a side view of an example vertical structure built from multiple blocks.

A vertical structure 150 is built from multiple blocks 100. In a first row 151*a*, a first block 100 is placed to the left of a second block 100. A left-hand end-piece 140L of the second block 100 is placed underneath a right-hand end-piece 140R of the first block 100. This has the effect that one internal element 131 of the second block 100 is placed underneath one internal element 131 of the first block 100, while the rest of the first block 100 and the second block 100 remain side by side.

A second row 151*b* is placed on top of the first row 151*a*. For a wall with blocks 100, the second row 151*b* can be offset horizontally from the first row 151*a* by 0, 1, 2, or any other integer number of pairs of internal elements, thus, possibly about half the width of a block 100. This can have the effect that natural positioning of blocks 100 places them in relatively strong places, as defined by the protrusions/recesses, unlike flat bricks, which might have to be measured to determine relatively strong positions. In one embodiment, adjacent end-to-end blocks and the row of blocks above and below can have tension rods, with the effect of tying the two ends of adjacent blocks together.

While the structure 150 is shown as a vertical assembly of blocks 100, in the context of the invention, there is no particular requirement for any such limitation. As further described herein, the structure 150 can include a horizontal assembly of blocks 100 forming a horizontal "wall," thus, a floor/ceiling.

Horizontal Structure

FIG. 1D show side view of an example horizontal structure built from multiple blocks. FIG. 1E shows a bottom side view of an example horizontal structure built from multiple blocks. In one embodiment, the example horizontal structures are disposed to provide a raised floor assembly, including multiple trapezoidal shaped blocks assembled directly adjacent to each other. These blocks have one more triangle facing up than the triangles facing down (or the reverse), so that the bottom portion thereof is longer that the top portion thereof (or the reverse).

A horizontal structure 160 is built from multiple blocks 100 and additional supporting elements. The additional supporting elements add to and support the natural self-supporting properties of the blocks 100. A set of trapezoidal blocks (thus, with one more upward-pointing triangle than downward-pointing triangle) are disposed side-to-side. This has the effect that a relatively flat bottom and a relatively flat top are created, such as for a floor or a raised floor. The side-to-side trapezoidal blocks are supported by a set of struts 161 disposed therebetween.

In one embodiment, the strut 161 can include a setting 161*a* and a support 161*b*. For example, the setting 161*a* can include a concrete filler 162*a* (as shown in FIG. 1D) or a metallic strut 162*b* (as shown in FIG. 1E), used to fill the gaps between the trapezoidal blocks. For another example, the support 161*b* can include a steel or concrete bar, used to support the setting 161*a*. One or more cross-supports (not shown) can be coupled (such as either horizontally at right angles to the supports, or horizontally or vertically at end-points of the cross-supports) to settings 161*a* or supports 161*b*. The cross-supports can include steel or concrete bars placed at right angles, or another angle, to the settings 161*a* or supports 161*b*.

As further described herein, when the vertical structure 150 or the horizontal structure 160 is curved, the struts 161 in the additional supporting elements, including the settings 161*a* or supports 161*b*, can be curved to match the vertical structure 150 or the horizontal structure 160. As further described herein, the additional supporting elements can add to and support the natural self-supporting properties of the blocks 100, which are effective even when the vertical structure 150 or the horizontal structure 160 is curved. Similarly, when the struts 161 are curved, the cross-supports can be curved to match the struts 161.

Internal Element Filler

In one embodiment, the internal elements 131 can include one or more substances suitable for altering the density, specific heat, or other building characteristics of one or more structures made from the blocks 100. Alternatively, the internal elements 131 can include either (1) air or other empty space, (2) a heavy structural material or lightweight insulate material, (3) other structural or thermal materials, or other materials. Alternatively, the internal elements 131 can include electrical wiring, pipes or other conduits, or other devices.

For example, after partially building one or more vertical structures 150 (walls) from the blocks 100, heavier concrete or other materials denser than the aerated concrete used to make the blocks 100 can be poured into lower rows 151. This can have the effect of adding weight to lower rows 151 of a vertical structure 150, and adding stability to the vertical structure 150.

As further described herein, the internal elements 131 can include a relatively strong, heavier concrete in some or all of the voids defined by those internal elements 131, possibly including reinforcing rods in those voids, with the effect of providing additional strength, such as for seismic loading or wind loading. When the relatively strong, heavier concrete is included, a hybrid type wall is provided that can be considered part standard masonry wall and part "insulated concrete form" (ICF) wall. An ICF wall is one way to provide a reinforced concrete wall with plastic insulating foam on the inside and/or the outside of the wall.

For another example, one or more devices or substances can be inserted into the blocks 100 when building a horizontal structure 160, or built into the horizontal structure 160, to increase/decrease the specific heat of that horizontal structure 160. When building a floor, devices or substances can be inserted into the blocks 100 to heat them during cold weather. When building a ceiling, devices or substances can be inserted into the blocks 100 to cool them during warm weather.

Introduction of either heavy structural material, such as concrete, in combination with steel reinforcing rods in the voids 131 can have the effect of adding additional strength to the wall or floor. The heavy material can also add thermal mass to the wall or floor, with the effect that it can slowly either emit or absorb heat to keep the internal space at a fairly stable temperature, similar to old style adobe. Thermal mass can also be added without the mass using phase change material that is reasonably lightweight, yet can absorb and emit heat by changing phase from solid to liquid (thus absorbing heat) or by changing phase from liquid to solid (thus emitting heat).

End-Pieces and Corner-Pieces

FIG. 2 (collectively including FIGS. 2A-2G) shows a conceptual drawing of a set of second example building blocks, and related components and structures, showing end-pieces and/or corner-pieces. FIG. 2A shows a top view of an example corner-piece block. FIGS. 2B-2C show two distinct oblique views of example corner-piece blocks. FIGS. 2D-2E show ensemble views of an example inside corner and an example outside corner built from corner-piece blocks. FIG. 2F shows an oblique view of an example end-piece block. FIG. 2G shows an oblique view of an example vertical structure built from multiple blocks, showing corners, edges, door/window spaces, and a horizontal structure including an ensemble of floor blocks.

In one embodiment, a corner-piece block has selected triangular elements half filled in, with the effect that the corner-piece block has a right-angle edge, perpendicular to first and second walls built using the corner-piece block, and with the effect that the corner-piece block has a substantially square space either at the top half or bottom half of the corner-piece block. Two such corner-piece blocks can be coupled at right angles, with the effect of forming an inside corner or an outside corner.

In one embodiment, an end-piece block can include a square block sized to fit into the substantially square shape. The square block includes wall protrusions and wall recesses, without spacing for landings, and shaped so that each 90-degree turn of the square block leaves an identical square block. The square block can be coupled to the corner-piece block, with the effect that the combination forms an end of a vertical structure.

A vertical structure with such an end can be disposed next to another vertical structure with such an end, to form a corner or to form a space, such as to create a door/window space. Alternatively, a horizontal structure with such an end can be disposed next to a vertical structure to form a floor or ceiling. A horizontal structure with such an end can be disposed next to another horizontal structure with such an end to form a partial floor/ceiling, such as a floor for a mezzanine, a cantilever, or a ceiling with a skylight.

Corner Piece Block

Figure 2A:
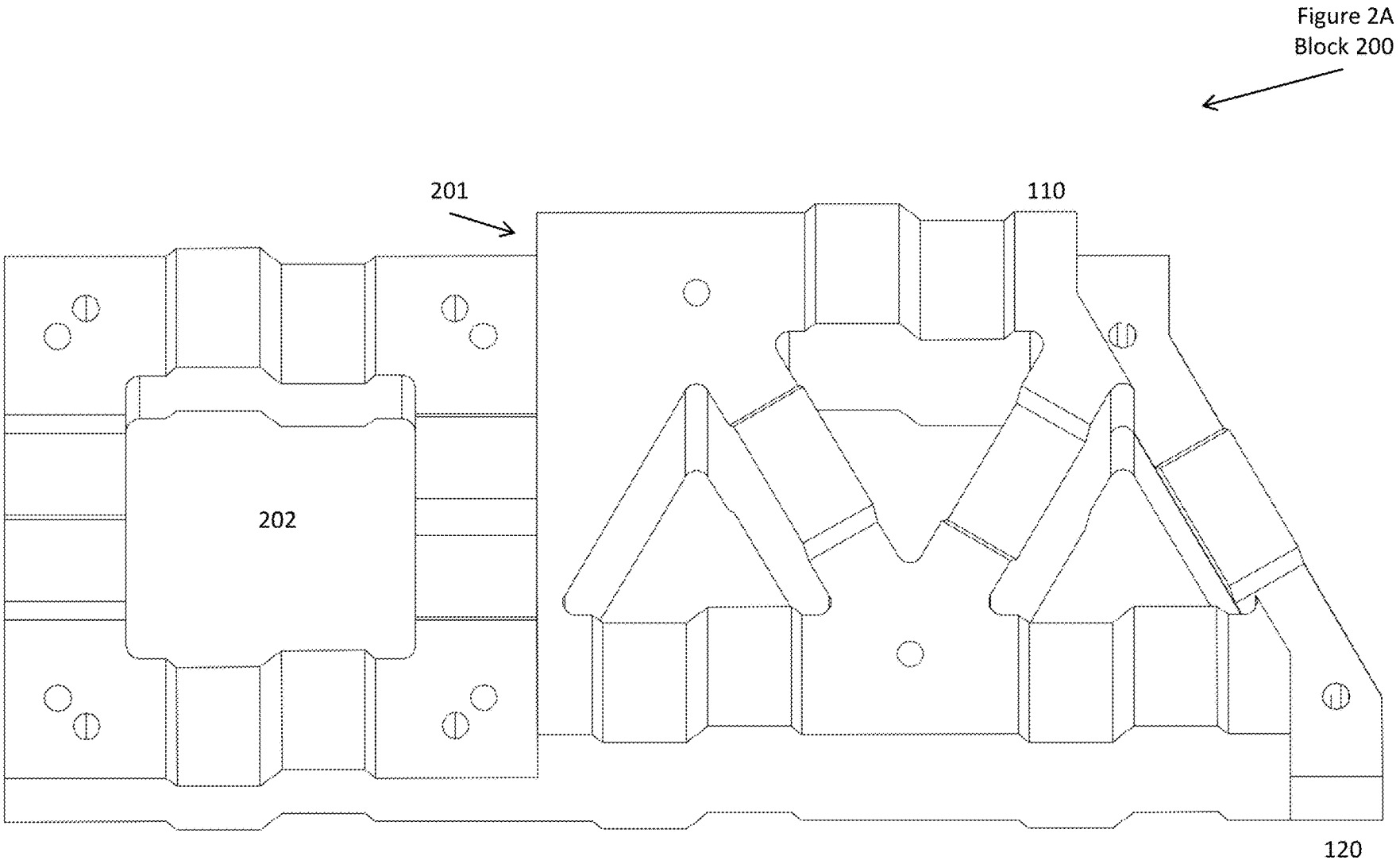
FIG. 2 (collectively including FIGS. 2A-2G) shows conceptual drawings of example building blocks, and related components and structures, showing end-pieces and/or corner-pieces.
Figure 2B:
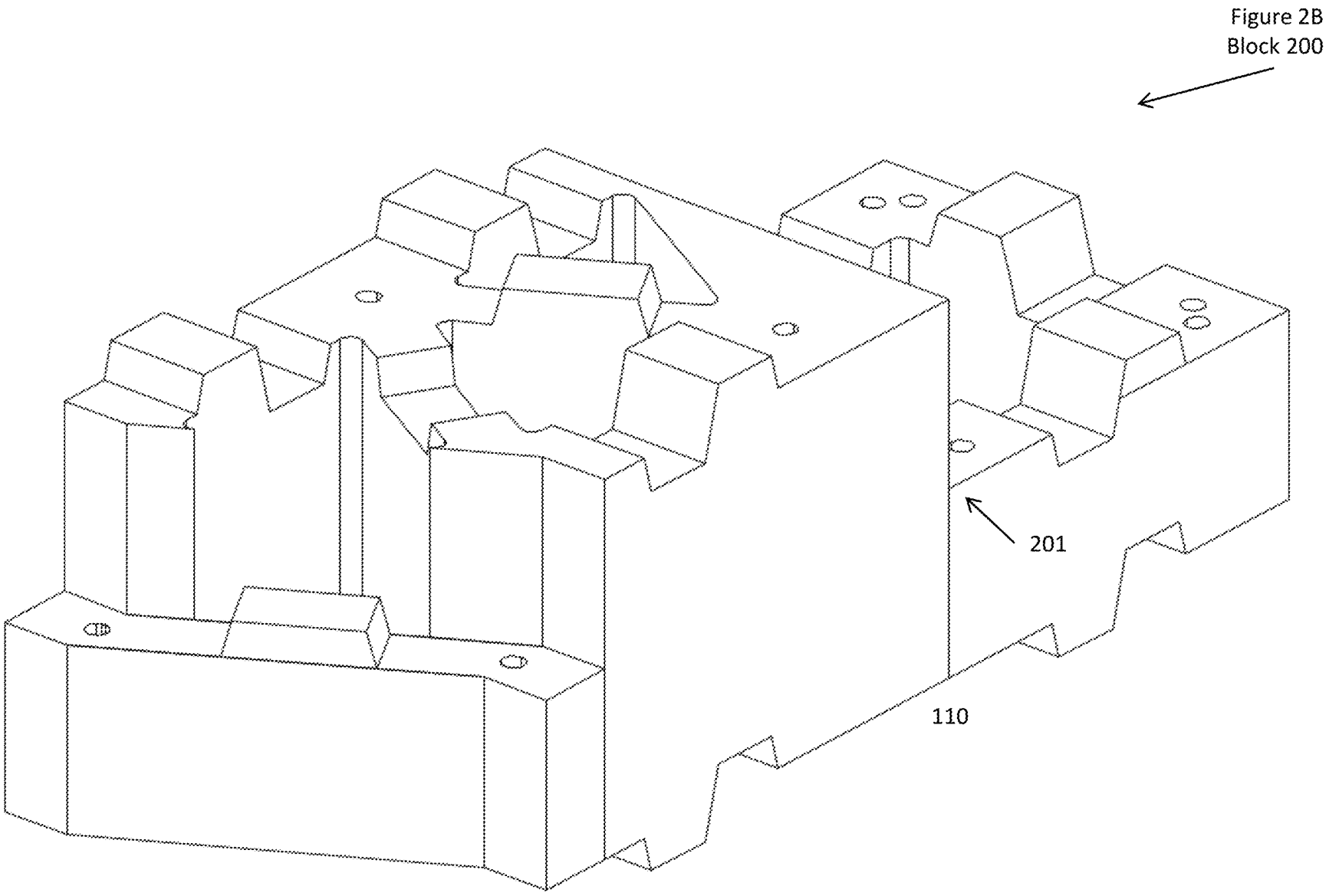
Figure 2C:
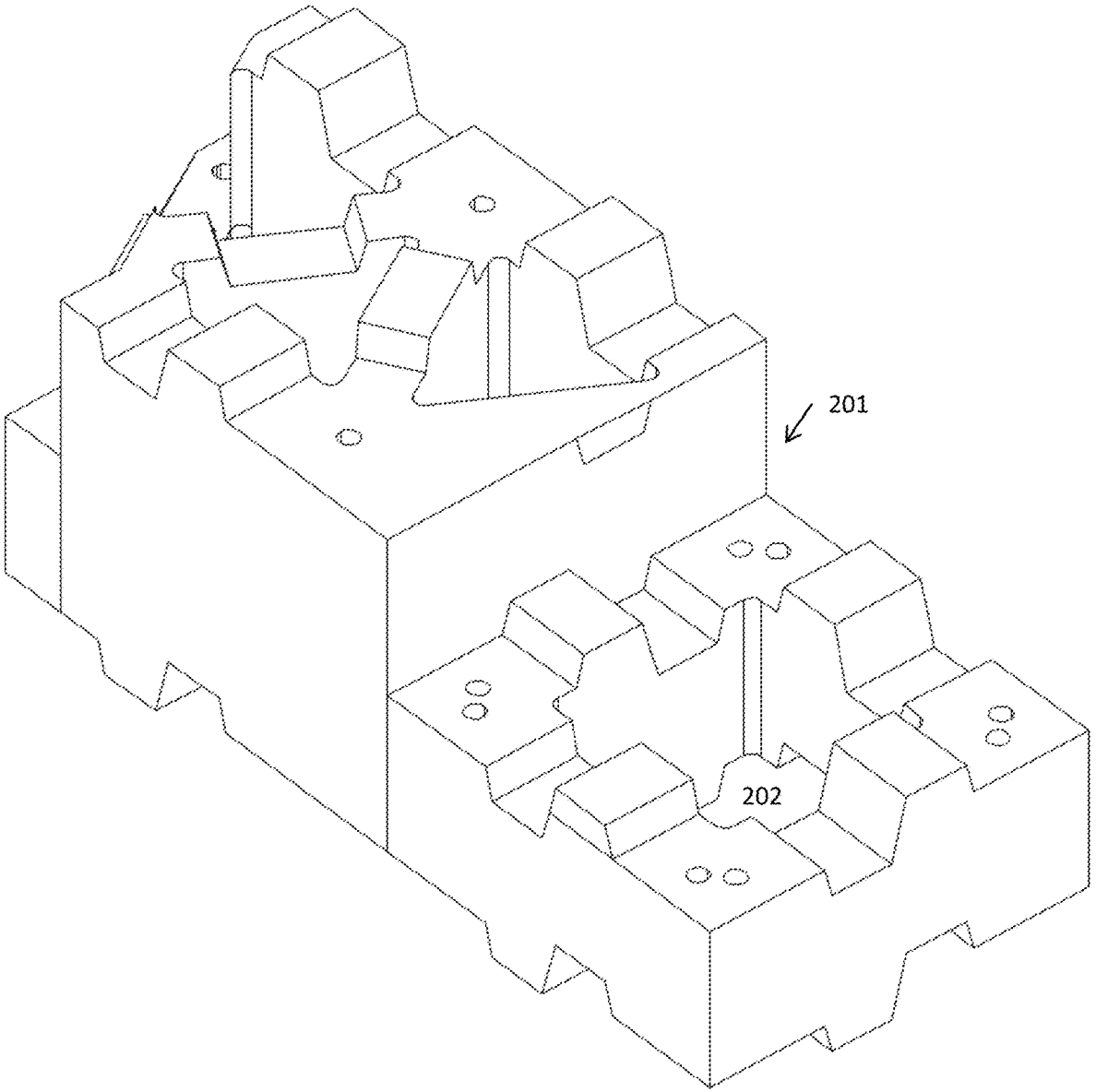

FIG. 2A shows a top view of an example corner-piece block. FIGS. 2B-2C show two distinct oblique views of example corner-piece blocks.

An example corner-piece block 200 has one or more (generally only one) internal element 131 (vertically) half filled in, that is, (vertically) only half cut out or shaped out from the aerated concrete. This can have the effect that the block 200 has a right-angle edge 201, perpendicular to the first wall 110 and second wall 120, and has a substantially square space 202 either at the top half 202*a* or bottom half 202*b* of the block 200.

Two such corner-piece blocks 200 can be coupled at right angles, one with its substantially square space 202 at the top half 202*a* of the block 200, and the other with its substantially square space 202 at the bottom half 202*b* of the block 200. When the two corner-piece blocks 200 are so coupled, they can form an inside corner 210 or an outside corner 220, depending on whether the corner-piece blocks 200 include an even number or an odd number of internal elements 131 before the end condition.

Alternatively, two such corner-piece blocks 200 can be coupled in alignment, one with its substantially square space 202 at the top half 202*a* of the block 200, and the other with its substantially square space 202 at the bottom half 202*b* of the block 200. When the two corner-piece blocks 200 are so coupled, they can form an extended-length block 100 of otherwise ordinary type (not shown). Optionally, square spaces 202 can be filled with substances such as described with respect to internal elements 131, such as (1) air or other empty space, (2) a heavy structural material with reinforcing support elements (such as steel rebar) or a lightweight insulate material, (3) other structural or thermal materials, or other materials. Alternatively, the square spaces 202 can optionally include electrical wiring, pipes or other conduits, or other devices.

Combined Corner-Pieces

Figure 2D:
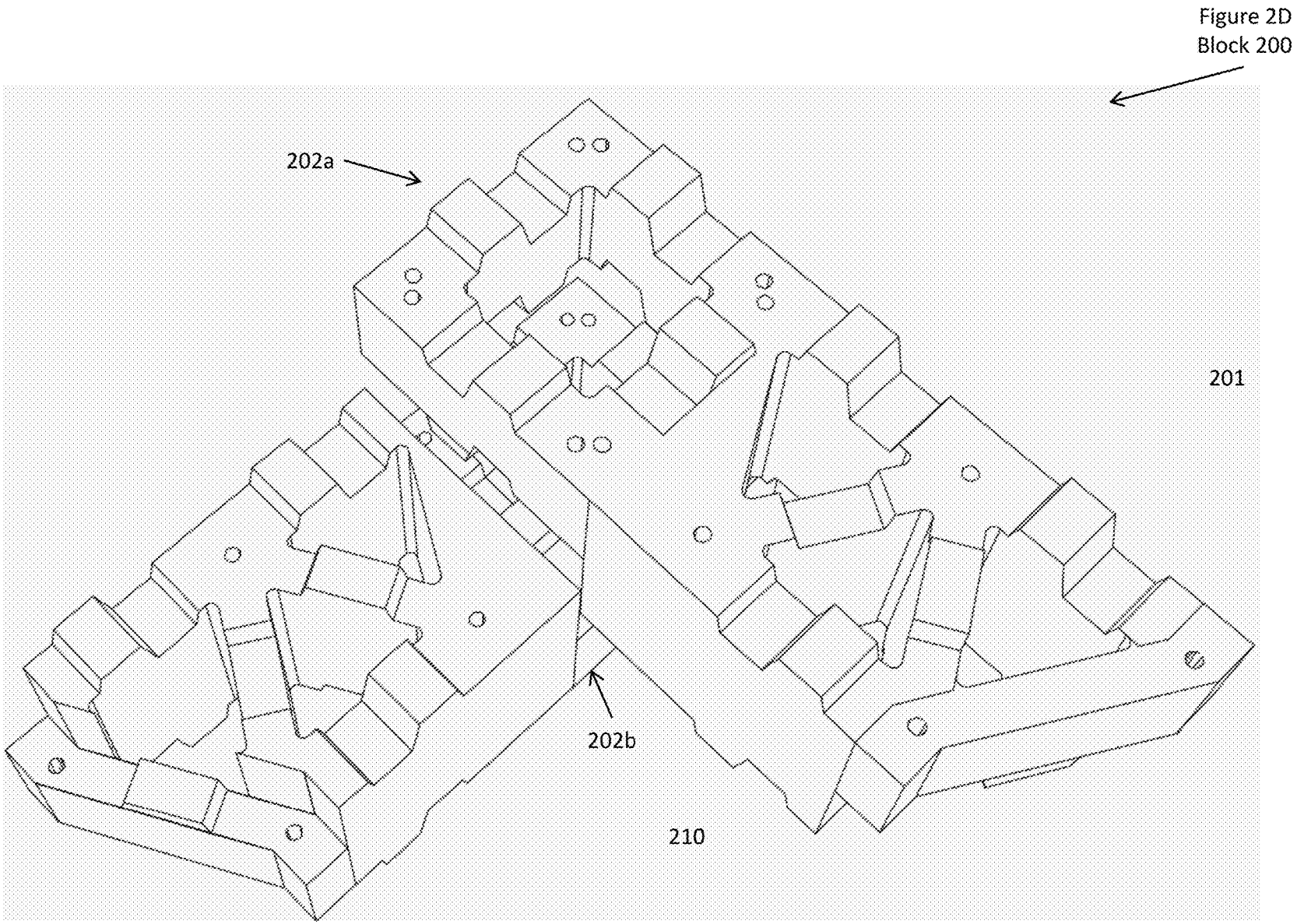
Figure 2E:
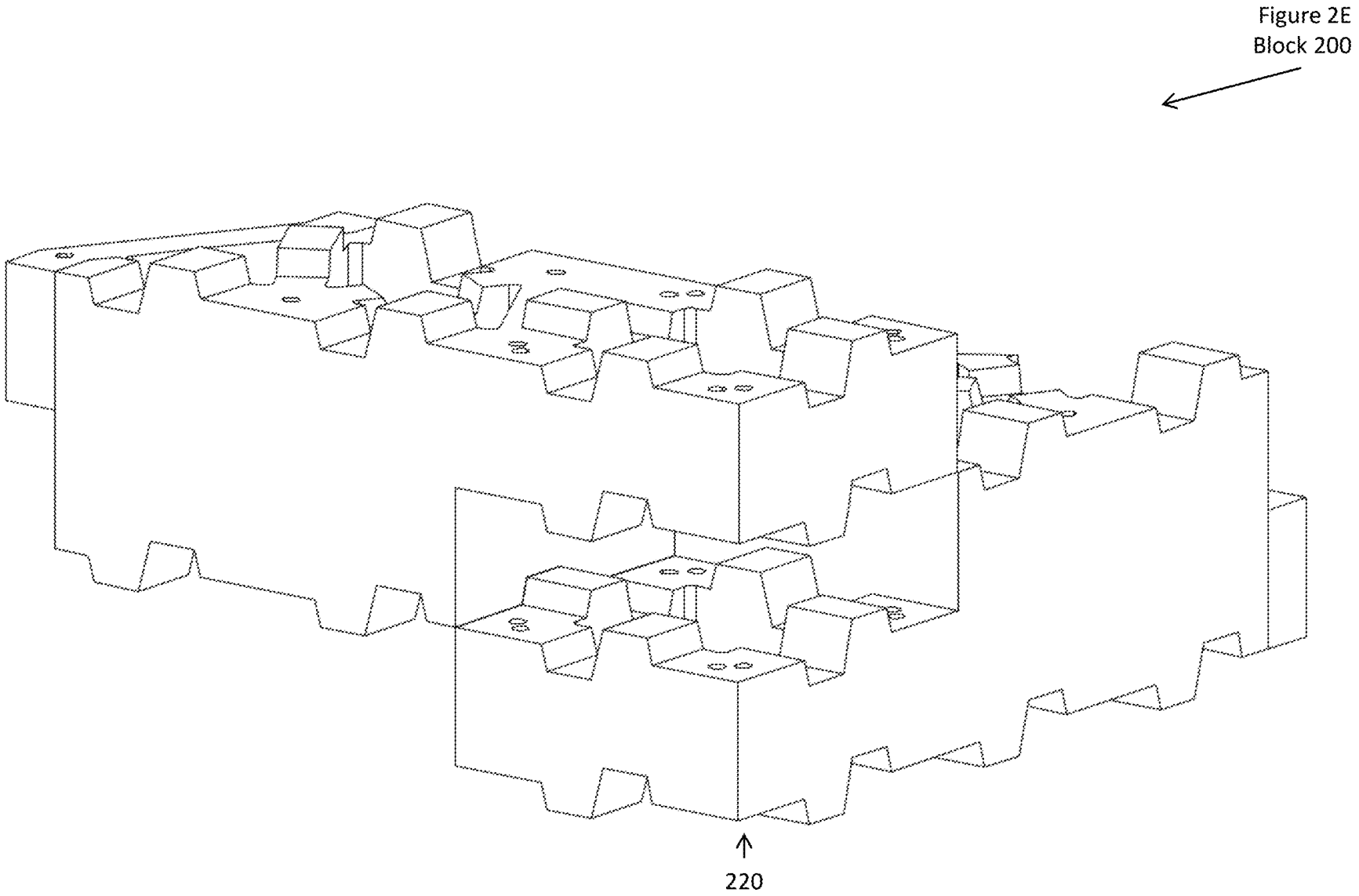

FIGS. 2D-2E show ensemble views of an example inside corner and an example outside corner built from corner-piece blocks.

The inside corner 210 includes a first corner-piece block 200 having an even number of internal elements 131 and a second corner-piece block 200 having an odd number of internal elements 131. The ensemble view shows an example coupling between the first corner-piece block 200 and the second corner-piece block 200.

In one embodiment, the outside corner 220 includes a first corner-piece block 200 having an (odd or even) number of internal elements 131 and a second corner 23 piece block 200 having an (odd or even) number of internal elements 131. The ensemble view shows an example coupling between the first corner-piece block 200 and the second corner-piece block 200.

While in each of these views the blocks show an odd number of internal elements 131 (triangular voids), after reading this application, those skilled in the art will recognize that the blocks can have either an odd number of internal elements 131 or an even number internal elements 131. These all can be linked together in the same structure to create an inside corner, an outside corner, or a straight wall. A straight wall can include a square void that can be filled with structural material similar to the corners. Straight wall pieces with their square void filled with structural material (such as concrete with steel rebar) can occur at a selected frequency based upon structural needs as defined by an engineer. This can provides additional lateral support for walls.

End-Piece Block

Figure 2F:
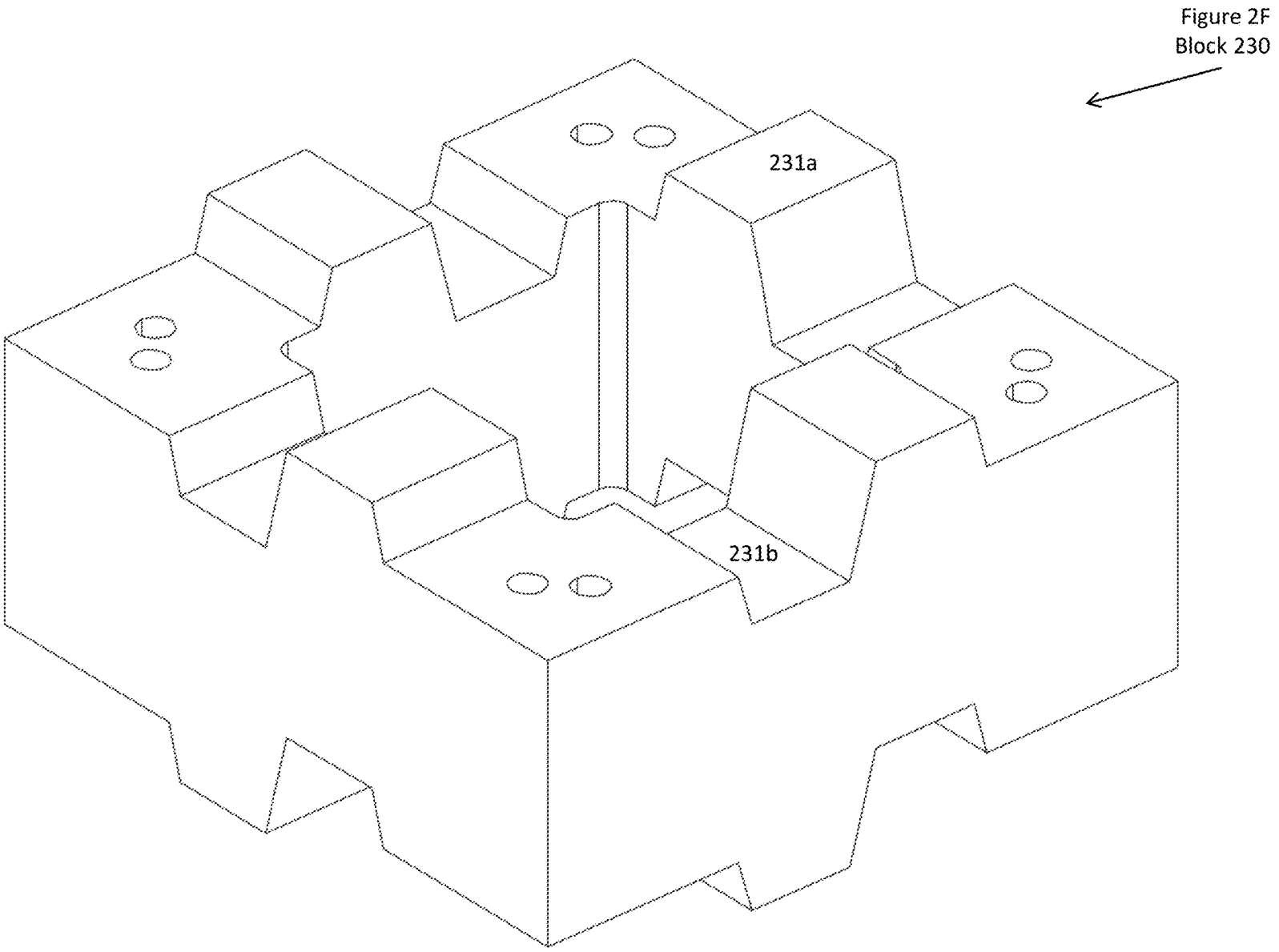

FIG. 2F shows an oblique view of an example end-piece block.

An example end-piece block can include a square block 230 sized to fit into the substantially square shape 202. The square block 230 includes wall protrusions 231*a* and wall recesses 231*b*. The wall protrusions 231*a* and wall recesses 231*b* are similar to wall protrusions 111*a* and wall recesses 111*b*. The wall protrusions 231*a* and wall recesses 231*b* are shaped so that each 90-degree turn of the square block 230 leaves an identical square block 230, that is, the square block 230 is invariant under a 90-degree turn.

The square block 230 can be coupled to the corner-piece block 200, with the effect that the combination forms an end of a vertical structure 150. A vertical structure 150 with such an end can be disposed next to another vertical structure 150 with such an end, to form a corner or to form a space. For example, a space can be formed to create a location at which to place a door or a window. A door or a window space can be formed with one or more additional blocks 100 for lintels, thresholds, and otherwise.

Corners, Edges, and Door/Window Spaces

Figure 2G:
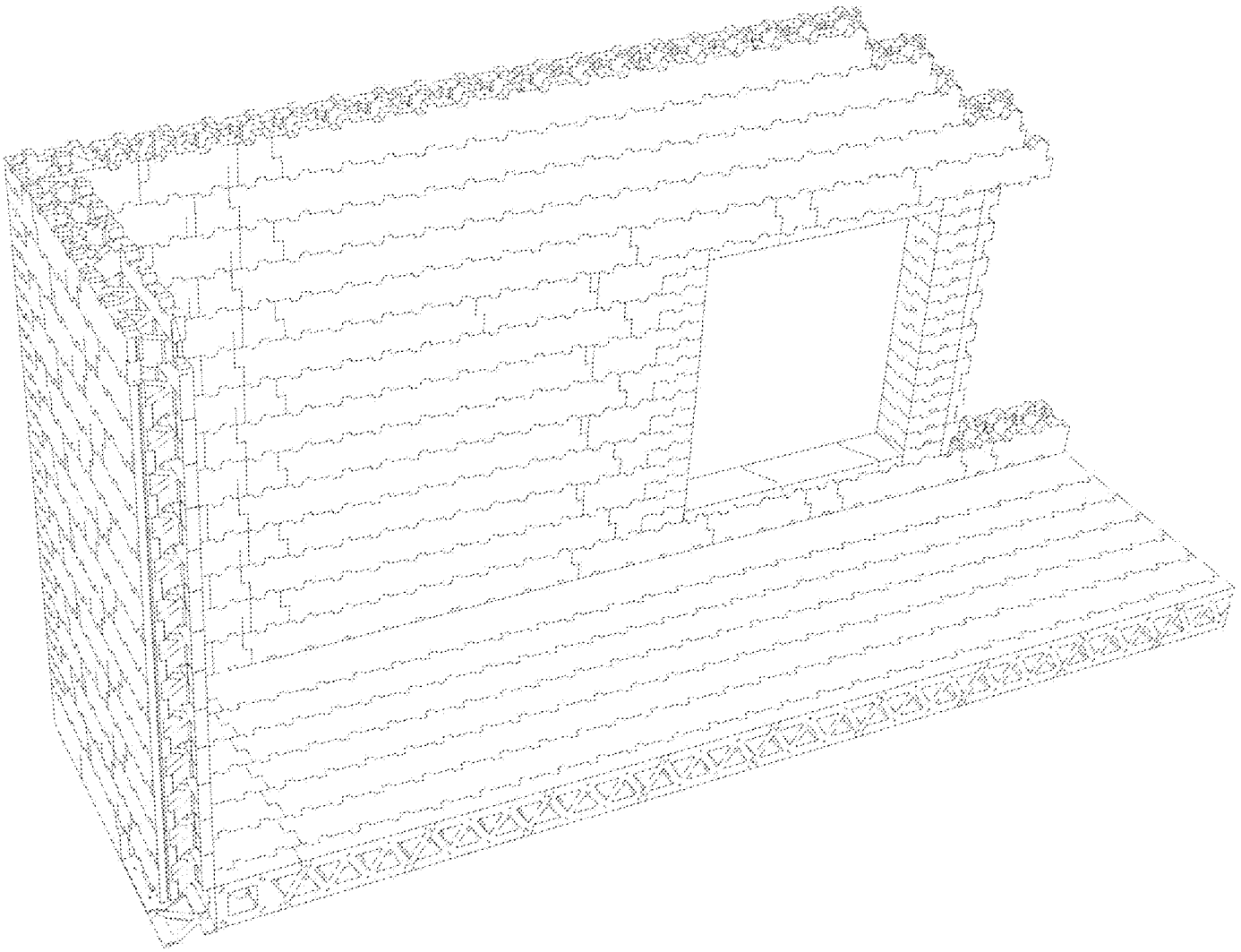

FIG. 2G shows an oblique view of an example vertical structure built from multiple blocks, showing corners, edges, and door/window spaces.

One or more vertical structures 150 can form a structure including one or more door/window spaces, floors/ceilings, similar structures, and otherwise. As further described herein, blocks 100 disposed on a flat support slab, such as a concrete slab or crushed rock, can be disposed without protrusions/recessions on their bottom supports. This can have the effect that the blocks 100 disposed on the flat support slab can sit flush on that slab.

Curvature and Curved Structures

FIG. 3 (collectively including FIGS. 3A-3F) shows a conceptual drawing of an example building block, and related components and structures, showing curvature. FIG. 3A shows an oblique view of an example block which can produce curvature in a horizontal plane, herein sometimes called a "tank block". FIG. 3B shows an oblique view of an example vertical structure built from multiple tank blocks. FIGS. 3C-3E show views of example blocks which can produce curvature in an arch or a tunnel, sometimes called "vault blocks". FIGS. 3F-3G show views of example horizontal structures built from multiple vault blocks, respectively from the bottom (FIG. 3E) and from the top (FIG. 3F).

In one embodiment, curved blocks (herein sometimes called "tank blocks") are bent in a horizontal plane, with the effect that a first wall and a second wall of a curved block have different lengths, and with the effect that the curved block is curved in shape. A tank block has a selected curvature so that multiple tank blocks can be assembled into a curved structure, such as a circle or a portion of a circle, to form a silo or similar structure.

When multiple tank blocks are assembled into a structure, they can form a circular wall. The circular wall can be built up into a vertical structure such as a silo, sometimes referred to herein as a "tank", possibly with spaces disposed therein. Spaces can be disposed in a circular wall by leaving areas defined by those spaces out of the assembled structure, or by constructing the assembled structure whole and removing the defined areas.

When multiple vault blocks are assembled into a structure, they can form an arch (for a ceiling) or a tunnel (for a floor), sometimes referred to herein as a "vault". Floor/ceiling structures can be supported as further described herein with respect to non-curved structures.

Curved Block (Tank Block Type)

Figure 3A:
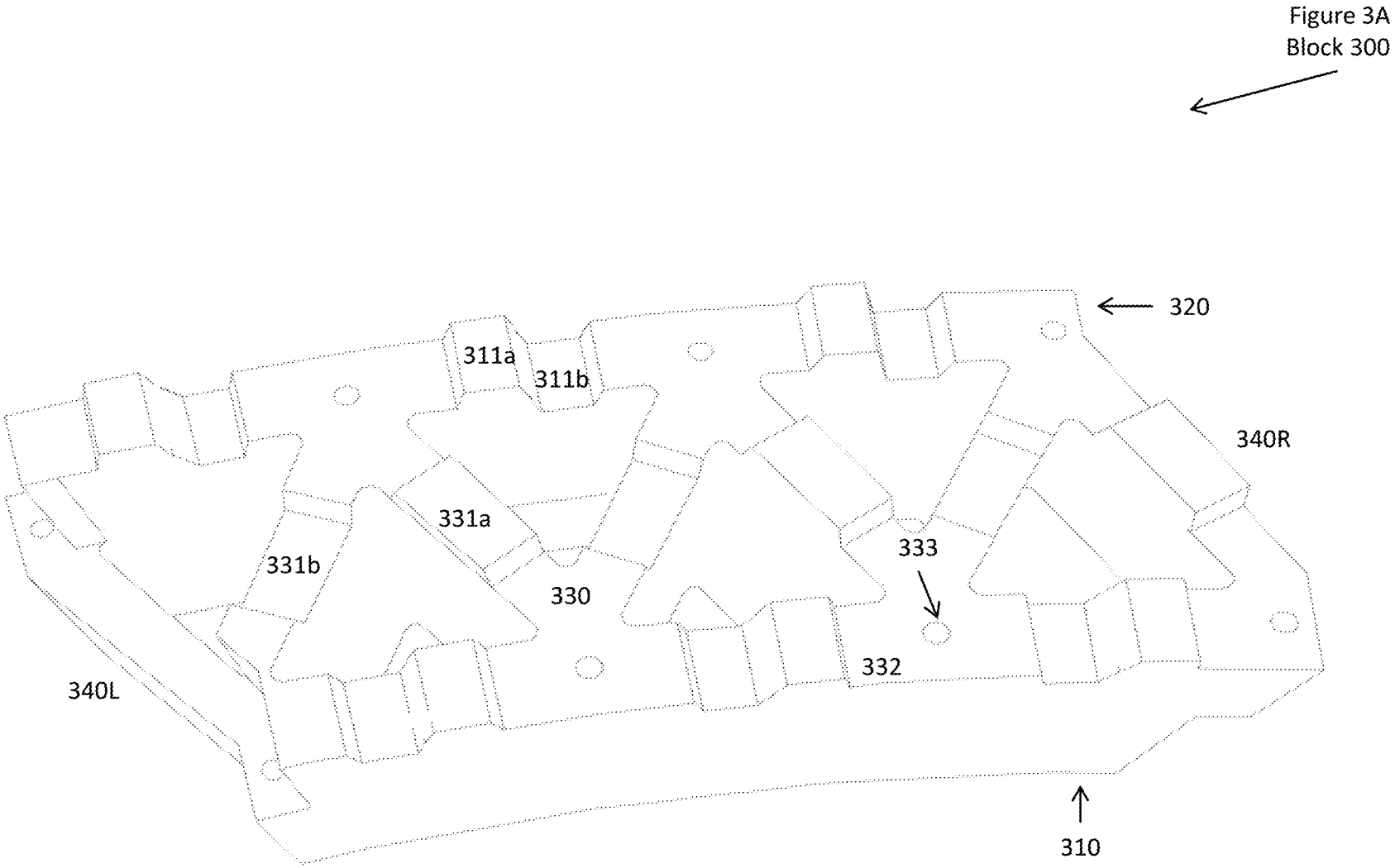
FIG. 3 (collectively including FIGS. 3A-3G) shows conceptual drawings of example building blocks, and related components and structures, showing curvature.

FIG. 3A shows an oblique view of an tank block, which can be disposed to produce curvature in a horizontal plane.

An example tank block 300 includes a first wall 310, a second wall 320, and one or more internal dividers 330, similar to the ordinary block 100. The internal dividers 330 define one or more internal elements 331, which can be disposed as equilateral triangles disposed in alternating up/down (as viewed from above) or in/out (as viewed from a side) directions, with an even number of such internal elements 331 for each tank block 300, also similar to the ordinary block 100. The internal elements 331 are similar to the internal elements 131, and can define empty space or fillings as further described herein. The internal elements 331 are iterated between the first wall 310 and the second wall 320, with the effect that the first wall 310 and the second wall 320 can have multiple internal elements 331 disposed between them. These elements are similar to the first wall 110, a second wall 120, the internal dividers 130, and the internal elements 131, as further described herein with respect to FIG. 1.

A right-hand end-piece 340R is defined by a right-hand side 331R of a right-hand internal element 331, similar to the ordinary block 100. A left-hand end-piece 340L is defined by a left-hand side 331L of a left-hand internal element 331, similar to the ordinary block 100. The right-hand end-piece 340R includes a downward pointing triangle disposed over an empty space, while the left-hand end-piece 340L includes an upward pointing triangle disposed under an empty space, similar to the ordinary block 100. These elements are similar to the right-hand end-piece 140R, the right-hand side 131R of the right-hand internal element 131, the left-hand end-piece 340L, and the left-hand side 331L of the left-hand internal element 331, similar to the ordinary block 100, as described with respect to FIG. 1.

The tank block 300 includes one or more curved wall protrusions 311*a* and curved wall recesses 311*b*, similar to the ordinary block 100. On each of the first wall 310 and the second wall 320, the curved wall protrusions 311*a* alternate with curved wall recesses 311*b*. These elements are similar to the wall protrusions 111*a* and wall recesses 111*b* described for the ordinary block 100 with respect to FIG. 1. Similar to the ordinary block 100, each tank block 300 fits on top of a tank block 300 it rests upon, and each tank block 300 is prevented from sliding along the top of the tank block 300 it rests upon.

The internal dividers 330 each define one or more internal protrusions 331*a* and internal recesses 331*b*. On the internal dividers 330, the internal protrusions 331*a* alternate with internal recesses 331*b*. These elements are similar to the internal protrusions 131*a* and internal recesses 131*b* described with respect to FIG. 1. Similar to the example block 100, each tank block 300 fits on top of a tank block 300 it rests upon, and each tank block 300 is prevented from sliding along the top of the tank block 300 it rests upon.

The internal dividers 330 also define one or more landings 332, where the internal dividers 330 meet the first wall 310 and the second wall 320. At these locations, the first wall 310 and the second wall 320 are at their level height without curved wall protrusions 311*a* or curved wall recesses 311*b*. Each landing 332 includes a through hole 333, through which a support rod/pipe (not shown) can be disposed. These elements are similar to the landings 132, through holes 133, and support rods/pipes, described with respect to FIG. 1.

The support rods/pipes can be coupled to a support structure (not shown), such as including a grid of cross-support rods/pipes (not shown), similar to the support rods/pipes, the support structure, and the cross-support rods/pipes, described with respect to FIG. 1.

Because of its curved shape, the tank block 300 is not as symmetrical about all of the X (lateral), Y (depth), and Z (height) axes, as the first example block 100. However, as further described herein, the tank block 300 is substantially symmetrical with respect to movement along the edge of a circular assembly 360 of tank blocks 300. Similarly, as further described herein, the tank block 300 is substantially symmetrical with respect to being flipped over so that the top and bottom are interchanged. While each individual row of tank blocks 300 can include blocks of the same top/bottom orientation, distinct rows of tank blocks 300 can include blocks of distinct top/bottom orientation.

Tank Block Structure

Figure 3B:
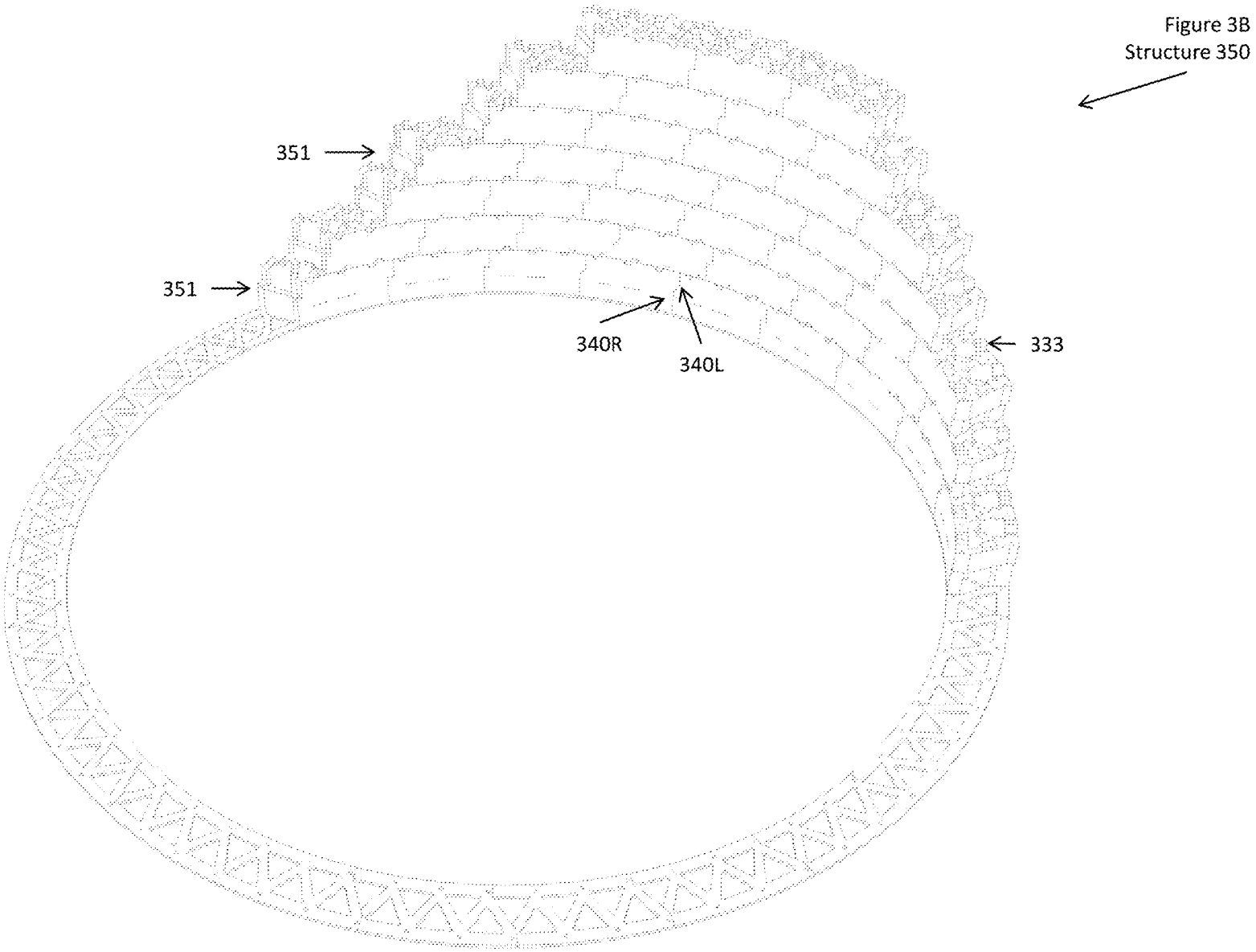

FIG. 3B shows an oblique view of an example vertical structure built from multiple tank blocks. The vertical structure can include a circular assembly, including one or more horizontal rows of tank blocks 300. As further described herein, each individual row of tank blocks 300 can include blocks of the same top/bottom orientation, and distinct rows of tank blocks 300 can include blocks of distinct top/bottom orientation.

A vertical structure 350, sometimes referred to herein as a "silo", can include tank blocks 300, assembled into curved rows 351, each of which includes an assembly of individual tank blocks 300.

As shown in the figure, multiple rows 351 of tank blocks 300 can be assembled into a vertical structure 350. In the vertical structure 350, a first row 351 includes multiple tank blocks 300 coupled at a first height, all coupled using their end-pieces 340R and 340L. A second row 351 includes multiple tank blocks 300 coupled at a second height, coupled at the same height in a similar manner as the first row 351, and also coupled to the first row 351 by being disposed on top of the multiple tank blocks 300 of the first row 351, as further described herein.

The through holes can include the support rods/pipes, which can be coupled to the support structure, such as cross-support rods/pipes, similar to the support rods/pipes, the support structure, and the cross-support rods/pipes, described with respect to FIG. 1. Flat-bottomed variants of tank blocks 300 can provide a structure onto which the tank blocks 300 can be coupled to a foundation or other support structure. Flat-topped variants of tank blocks 300 can provide a pleasing look at a top of the vertical structure 350.

The vertical structure 350 can optionally include one or more door/window spaces, similar to the door/window spaces described with respect to FIG. 1. The vertical structure 350 can also optionally include one or more door/window spaces, cut into the assembled tank blocks 300, such as a circular window or a window having another shape. Flat-topped variants or flat-bottomed variants of tank blocks 300 can provide a pleasing look at a top or bottom of one or more door/window spaces.

Curved Block (Vault Block Type)

Figure 3C:
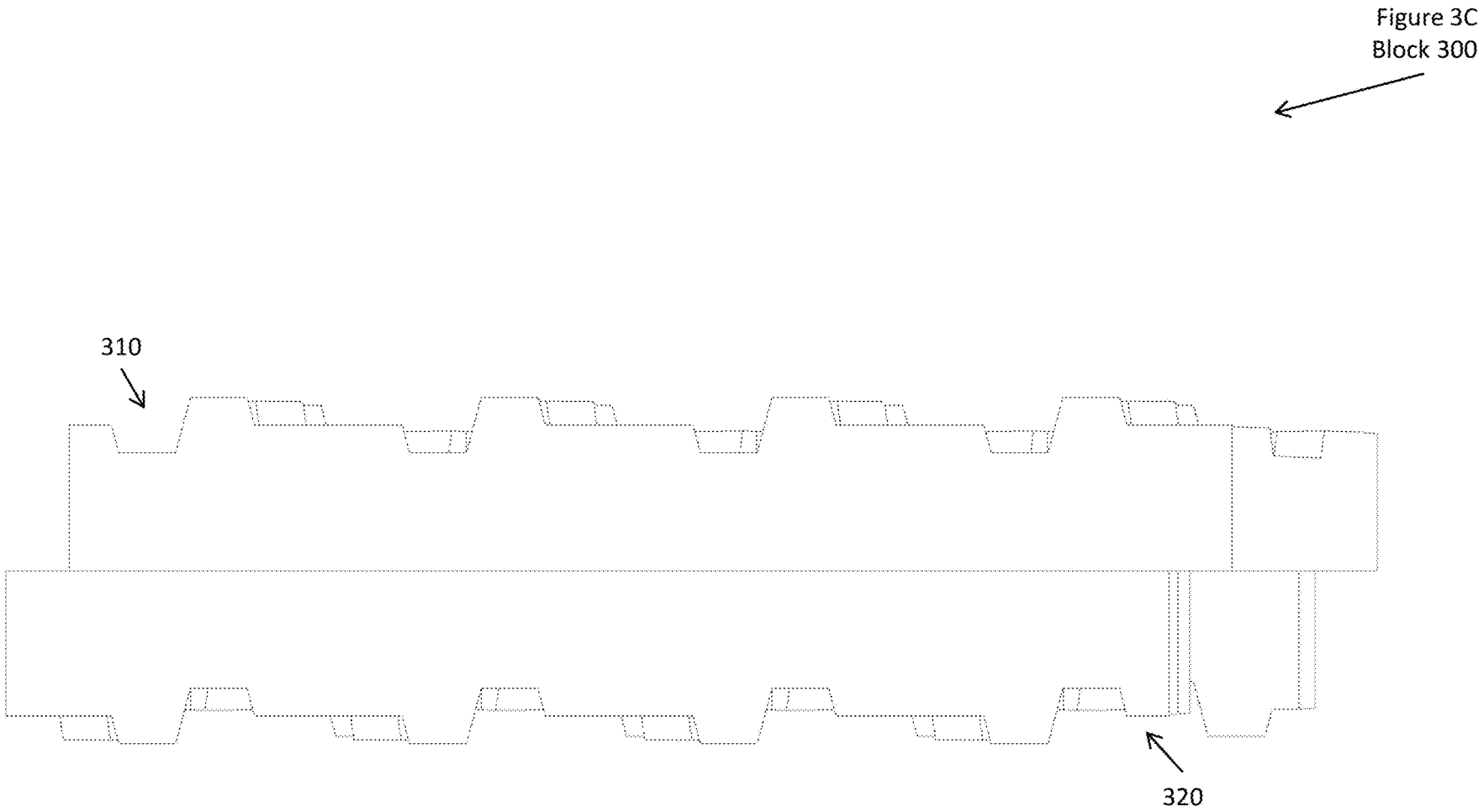
Figure 3D:
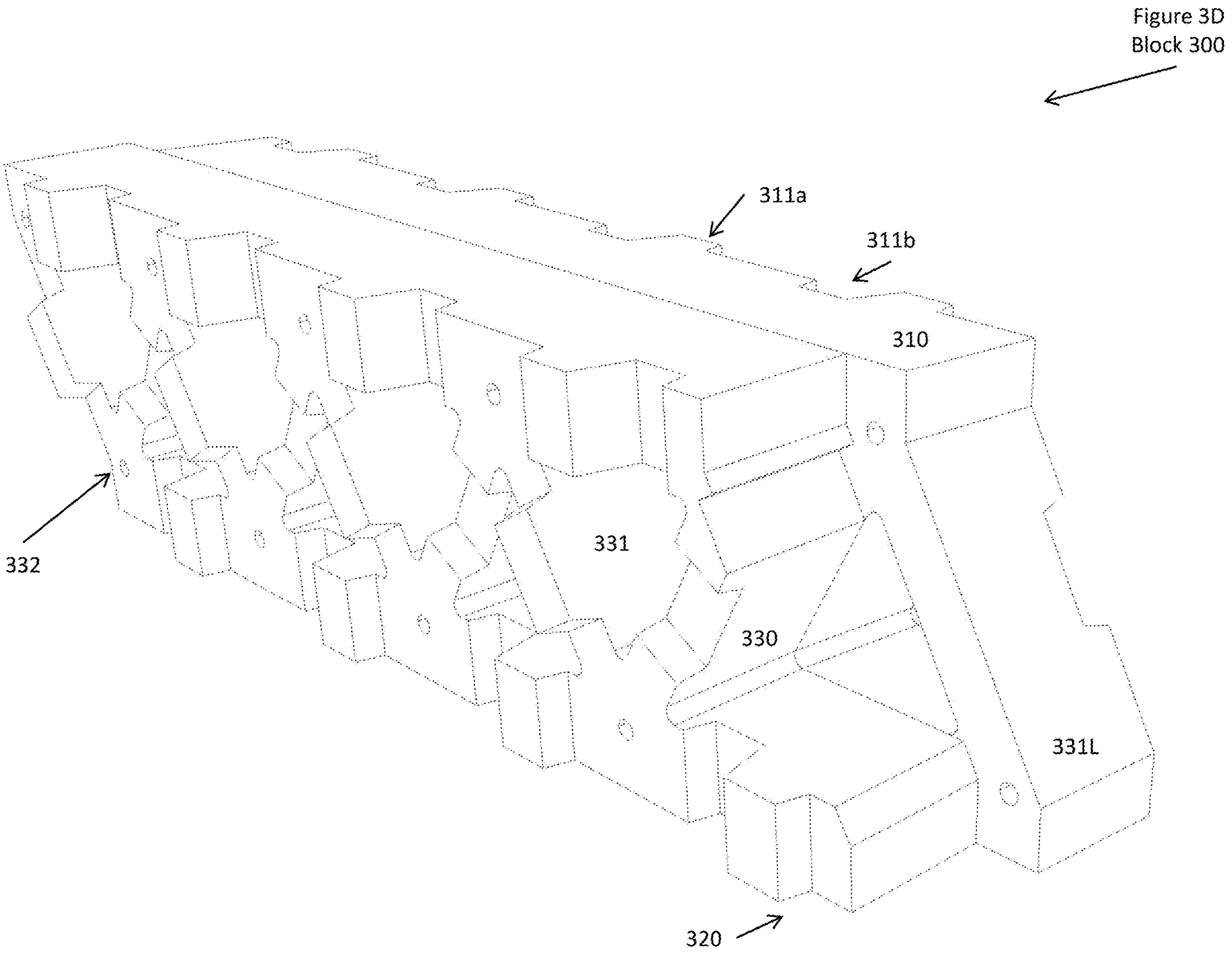
Figure 3E:
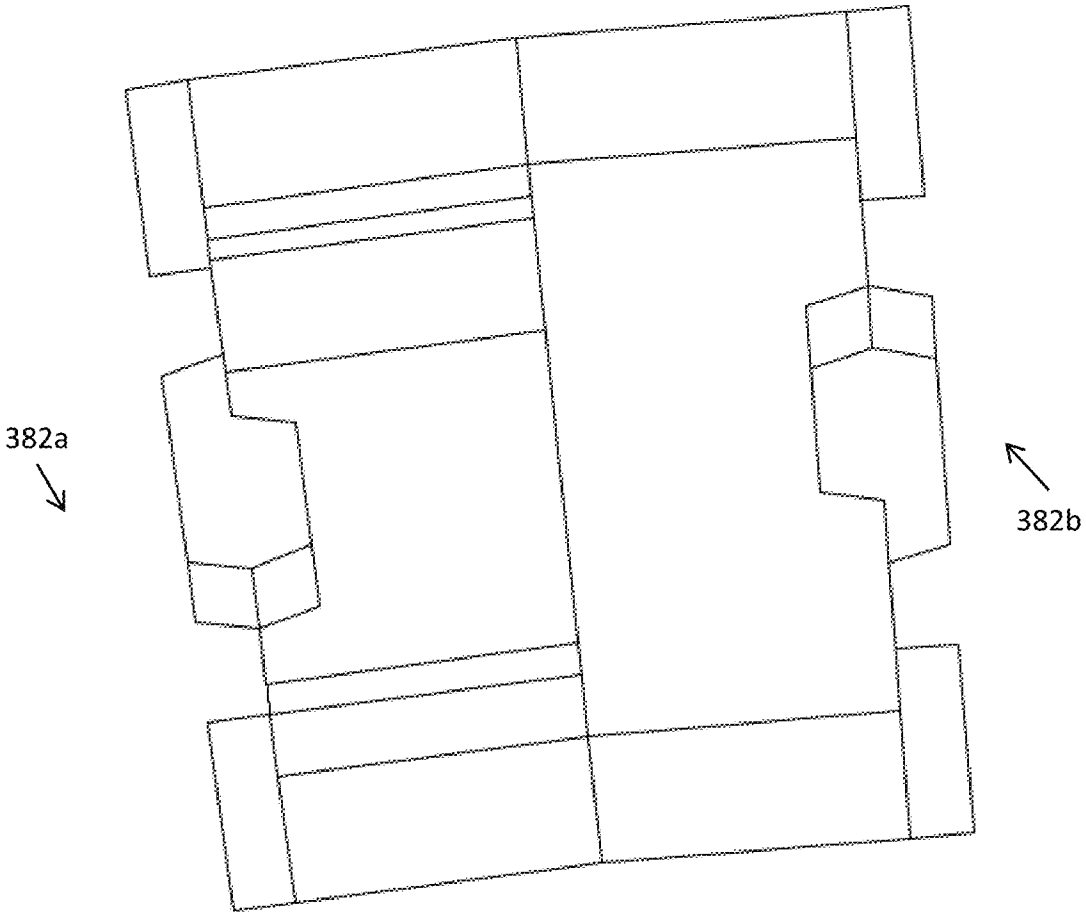

FIG. 3C shows a top view of an example vault block. FIG. 3D shows an oblique view of an example vault block. FIG. 3E shows an end view of an example vault block. Each vault block 300 is similar to an ordinary block 100, except that a wedge-shaped section has been removed from the vault block 300, with the effect that a first side of the vault block 300 is disposed in a plane at a slight angle from a second side of the vault block 300. This can have the effect that each vault block 300 imposes a slight curve in the shape of a horizontal structure 370, sometimes referred to herein as a "vault", to form an arch or tunnel, as further described herein.

An example vault block 300 can include a first wall 310, a second wall 320, and one or more internal dividers 330, similar to the ordinary block 100. The internal dividers 330 define one or more internal elements 331, which can be disposed as equilateral triangles disposed in alternating up/down (as viewed from above) or in/out (as viewed from a side) directions, with an even number of such internal elements 331 for each vault block 300, also similar to the ordinary block 100. The internal elements 331 are similar to the internal elements 131, and can define empty space or fillings as further described herein. The internal elements 331 are iterated between the first wall 310 and the second wall 320, with the effect that the first wall 310 and the second wall 320 can have multiple internal elements 331 disposed between them. These elements are similar to the first wall 110, a second wall 120, the internal dividers 130, and the internal elements 131, described for the ordinary block 300 with respect to FIG. 1.

A right-hand end-piece 340R is defined by a right-hand side 331R of a right-hand internal element 331, similar to the ordinary block 100. A left-hand end-piece 340L is defined by a left-hand side 331L of a left-hand internal element 331, similar to the ordinary block 100. The right-hand end-piece 340R includes a downward pointing triangle disposed over an empty space, while the left-hand end-piece 340L includes an upward pointing triangle disposed under an empty space, similar to the ordinary block 100. These elements are similar to the right-hand end-piece 140R, the right-hand side 131R of the right-hand internal element 131, the left-hand end-piece 340L, and the left-hand side 331L of the left-hand internal element 331, similar to the ordinary block 100, as described with respect to FIG. 1.

The vault block 300 includes one or more wall protrusions 311*a* and wall recesses 311*b*, similar to the ordinary block 100. On each of the first wall 310 and the second wall 320, the wall protrusions 311*a* alternate with wall recesses 311*b*. These elements are similar to the wall protrusions 111*a* and wall recesses 111*b* described for the ordinary block 100 with respect to FIG. 1. Similar to the ordinary block 100, each vault block 300 fits on top of (or to the side of) a vault block 300 it rests upon (or against), and each vault block 300 is prevented from sliding along the top (or side) of the vault block 300 it touches.

In one embodiment, the vault block 300 is disposed so that a plane 361*a* substantially defining one side is disposed at a slight angle to a plane 361*b* substantially defining its other side. In one embodiment, the vault block 300 can be constructed using similar techniques as the ordinary block 300, but with a slight wedge removed from a center portion of the vault block 300. This can have the effect that the planes 361*a*, 361*b* are disposed at slight angles. When multiple vault blocks 300 are composed into a structure, the slight angles cumulate, with the effect that a curved structure can be formed.

Vault Block Structure

Figure 3F:
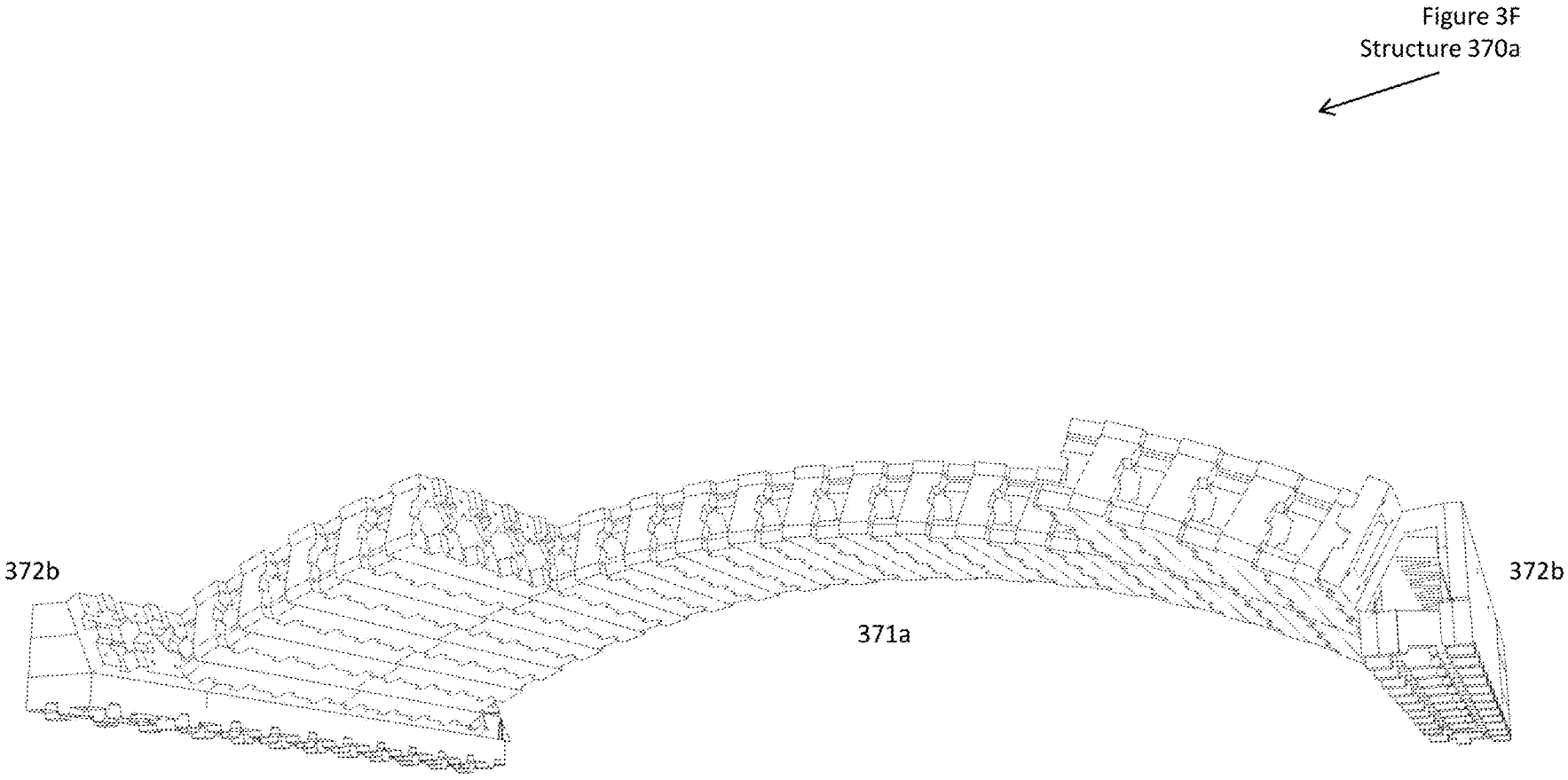
Figure 3G:
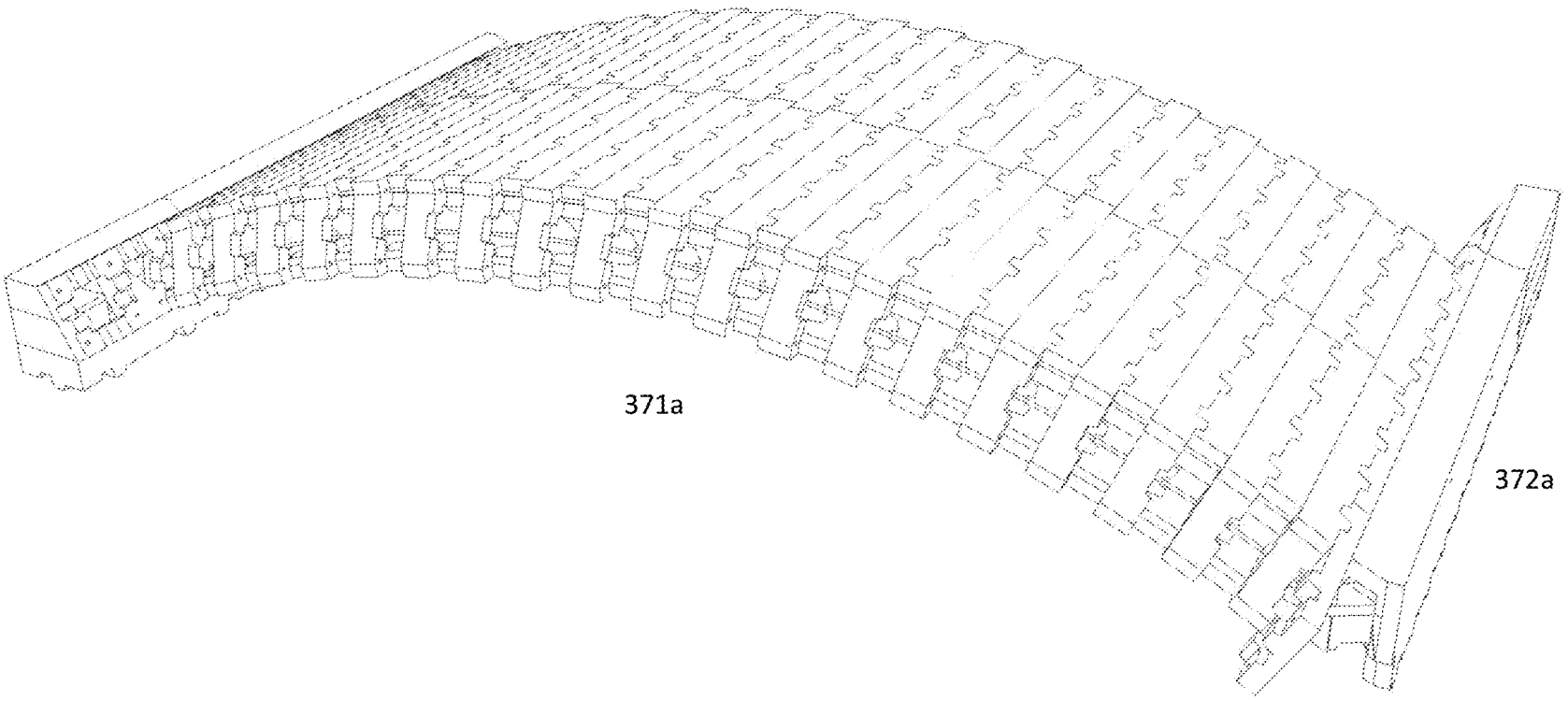
Figure 4A:
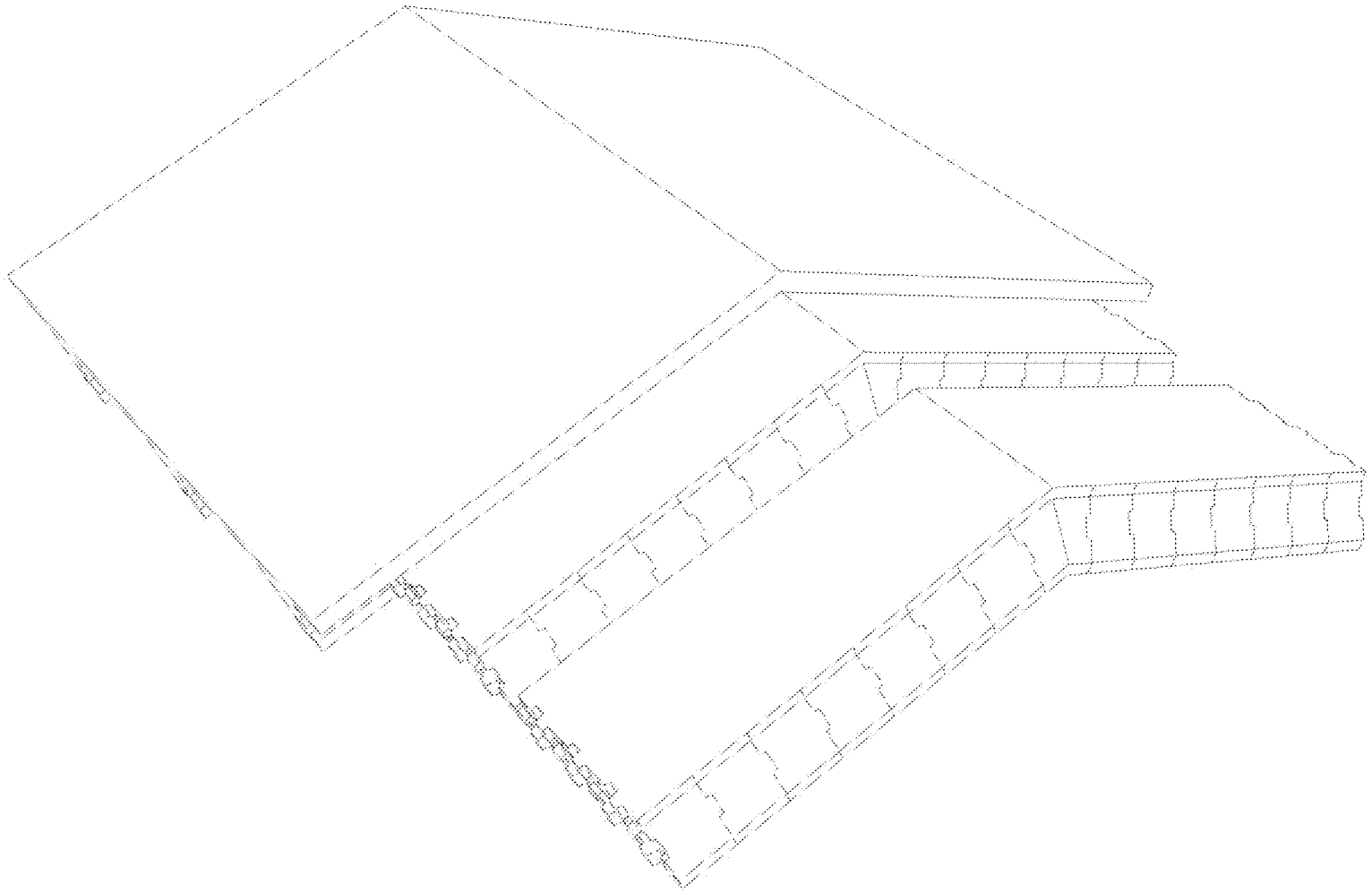
FIG. 4 (collectively including FIGS. 4A-4D) shows a conceptual drawing of example bent horizontal structures built from multiple building blocks and other related elements, and related components and structures.
Figure 4B:
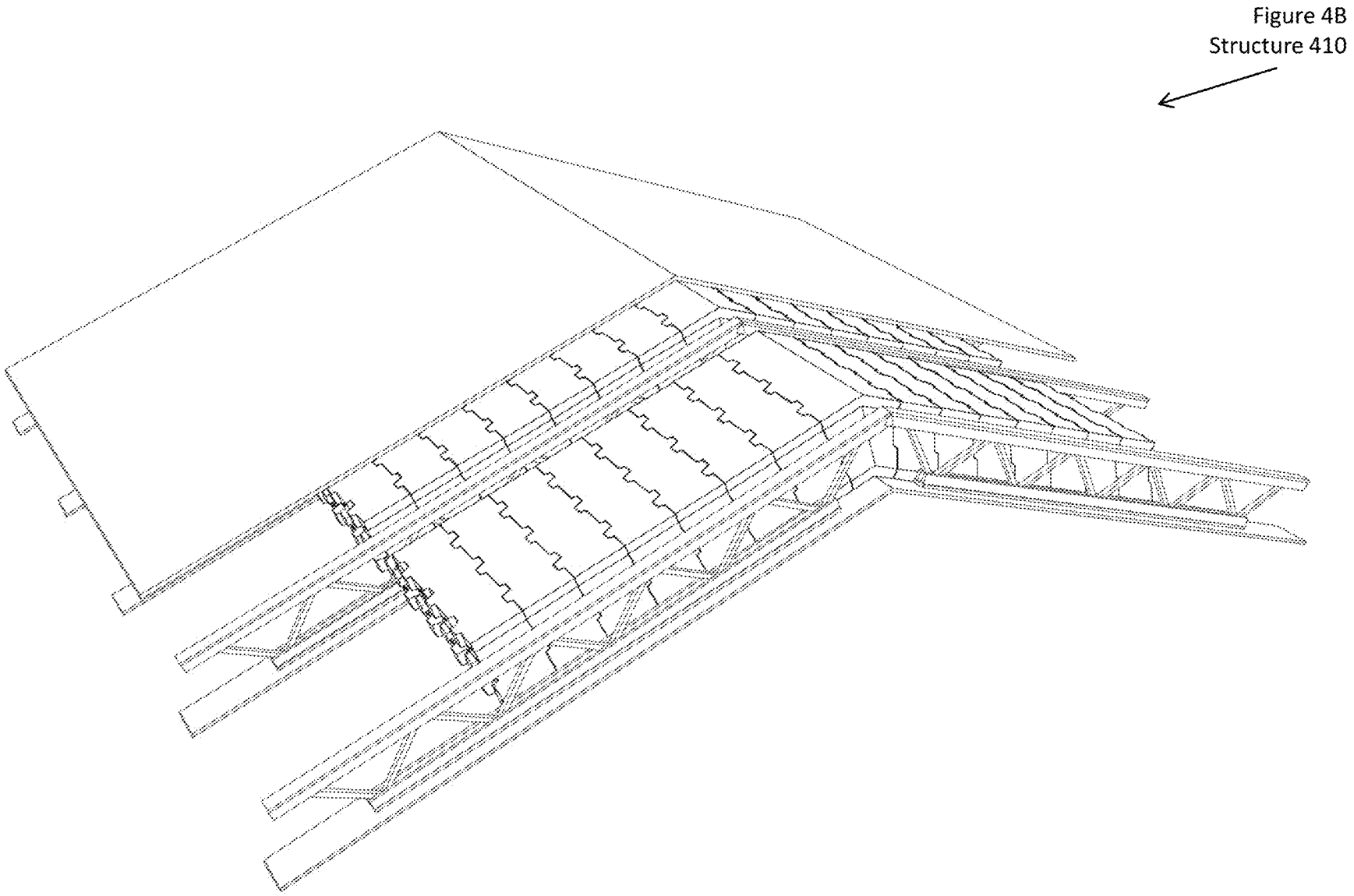
Figure 4C:
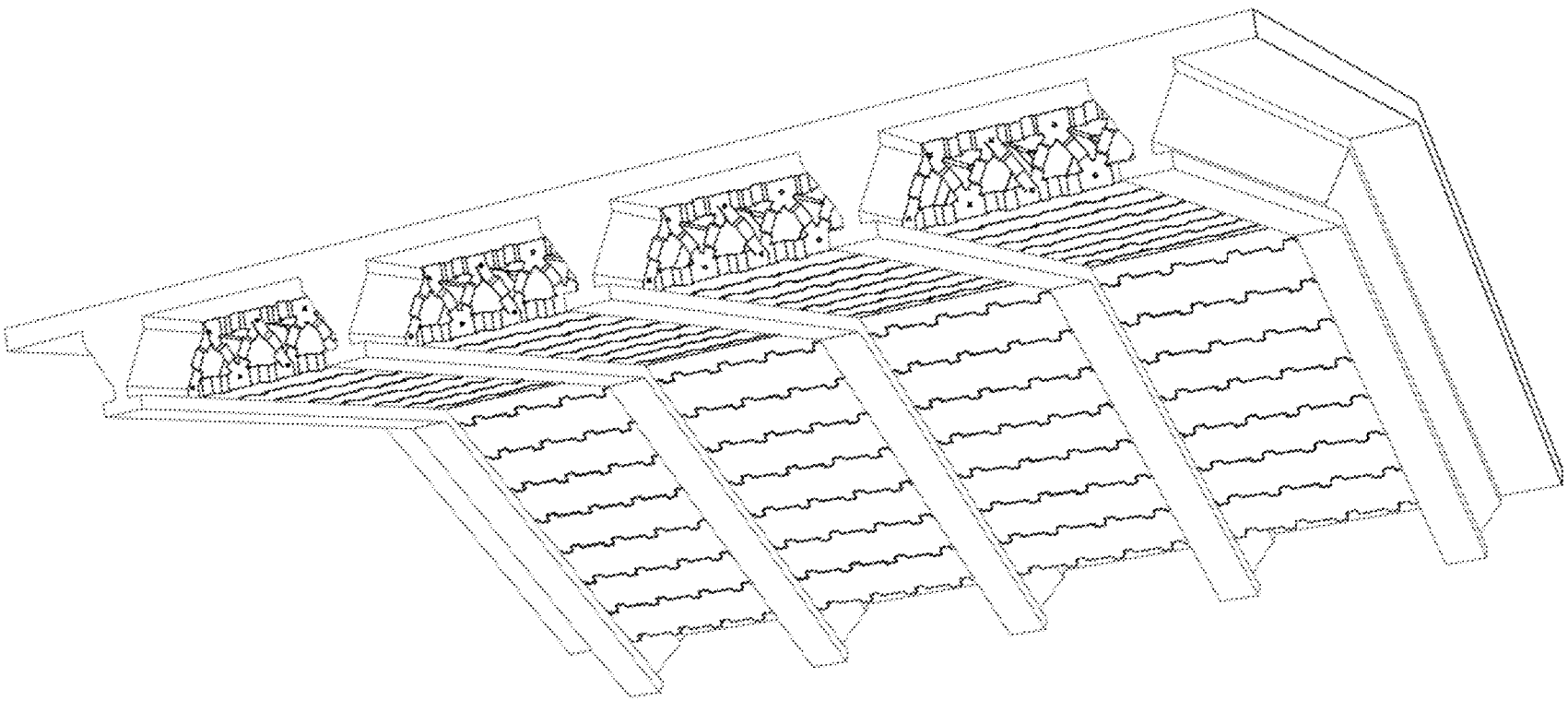
Figure 4D:
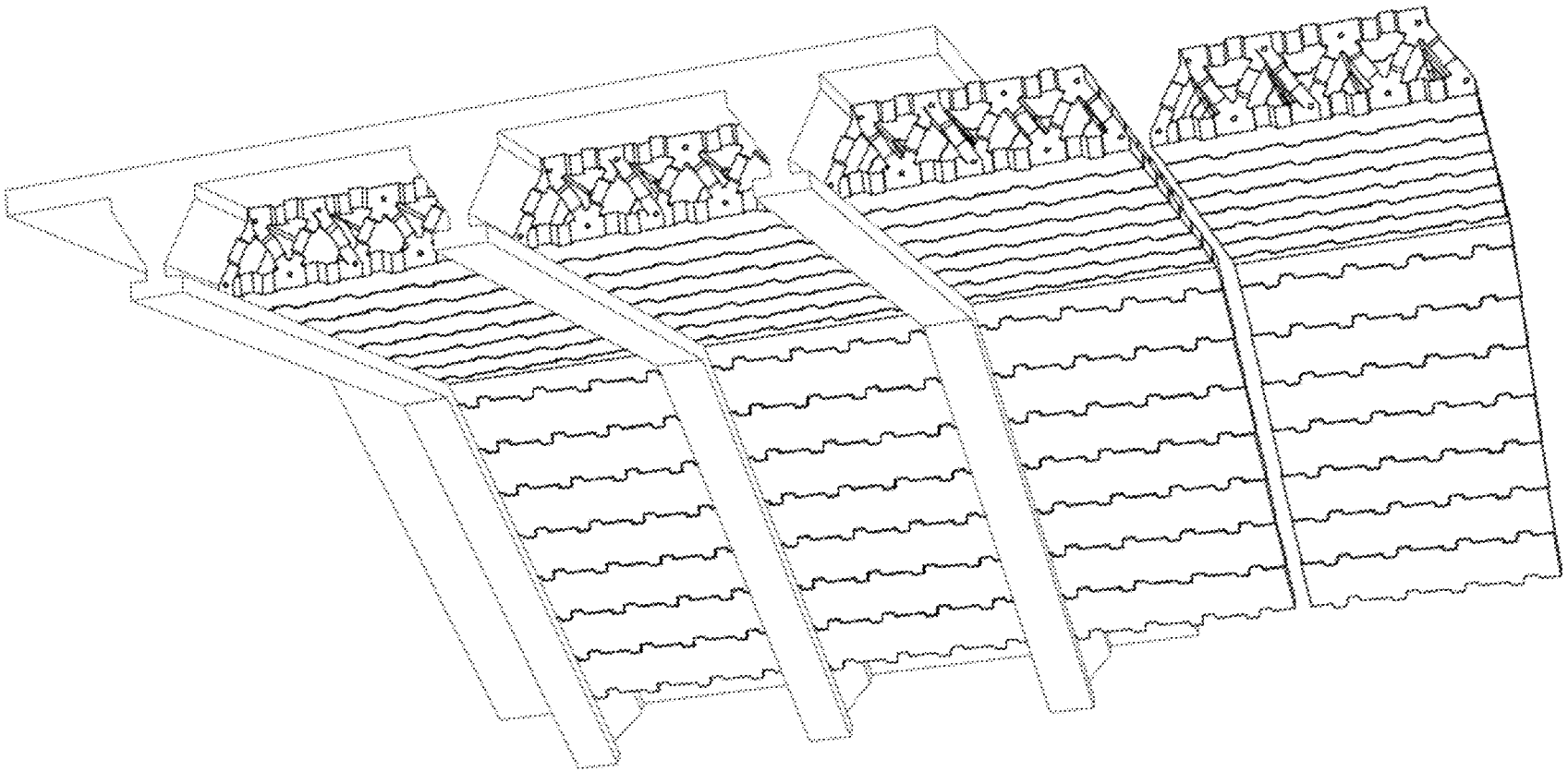

FIG. 3F-3G show views of example horizontal structures built from multiple vault blocks, showing curvature of those horizontal structures.

In FIGS. 3F and 3G, a first curved horizontal structure 370, sometimes referred to herein as a "vault", includes multiple vault blocks, such as forming an arch, with a middle part 371*a* higher than its edges 372*a*. Corner-piece variants of vault blocks 300 can provide a pleasing look at edges of the first horizontal structure 370.

Bent Horizontal Structures

FIG. 4 (collectively including FIGS. 4A-4D) shows a conceptual drawing of example bent horizontal structures built from multiple building blocks and other related elements, and related components and structures.

A bent horizontal structure 410 includes a part of an otherwise-vertical wall, disposed on its side, bent at an angle in the middle, such as forming a straight wall with an angular bend 420, such as forming a roof with two side panels 430 and a peak 440.

The bent horizontal structure 410 is similar to the horizontal structure built with ordinary blocks 100, with the distinction that the bent horizontal structure 410 has a bent formation with the angular bend 420 at a designated location in the structure.

Other Components and Structures

Figure 5A:
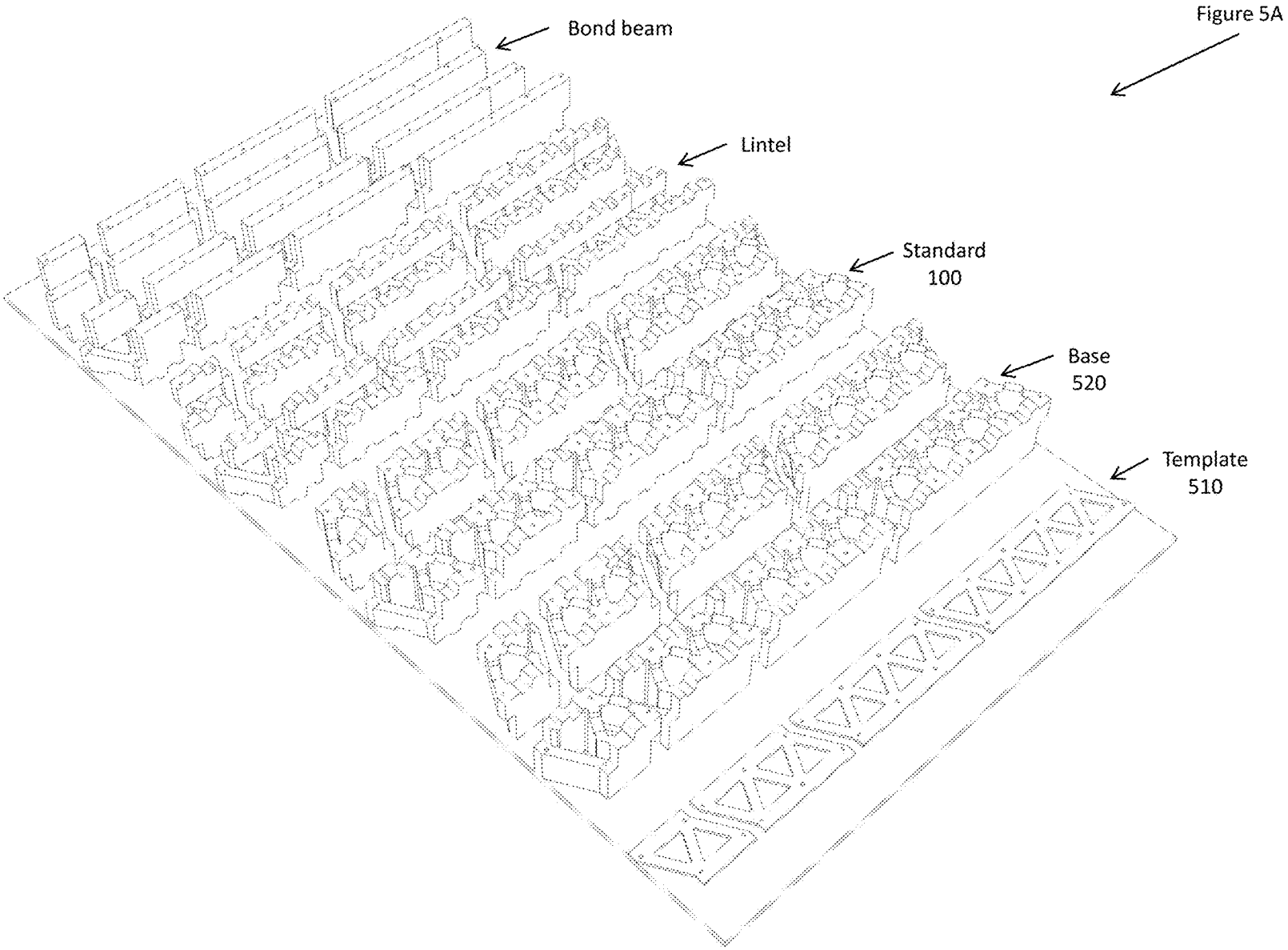
FIG. 5 (collectively including FIGS. 5A-5C) shows conceptual drawings of other example building blocks, related components and structures, and other related elements.
Figure 5B:
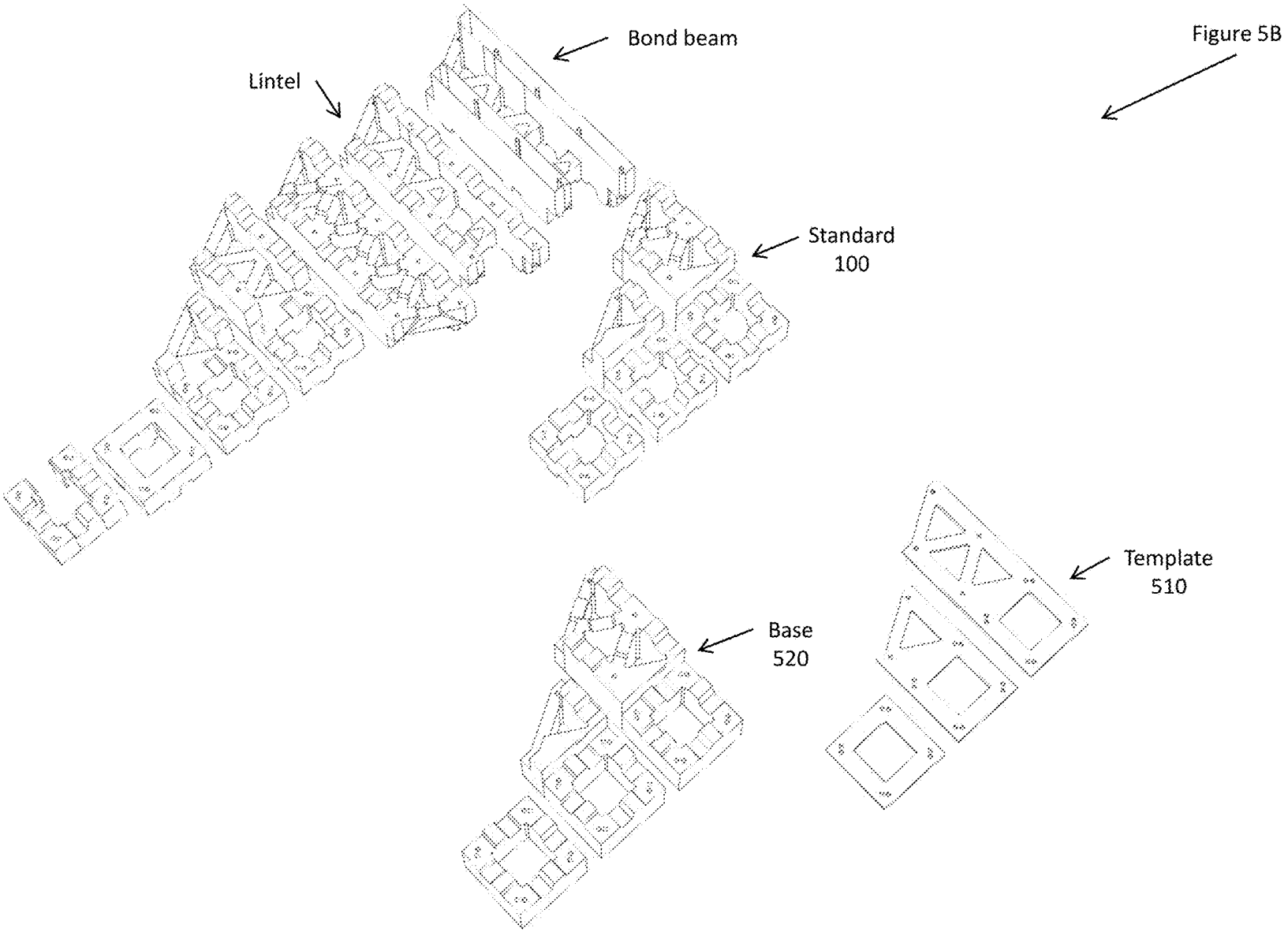
Figure 5C:
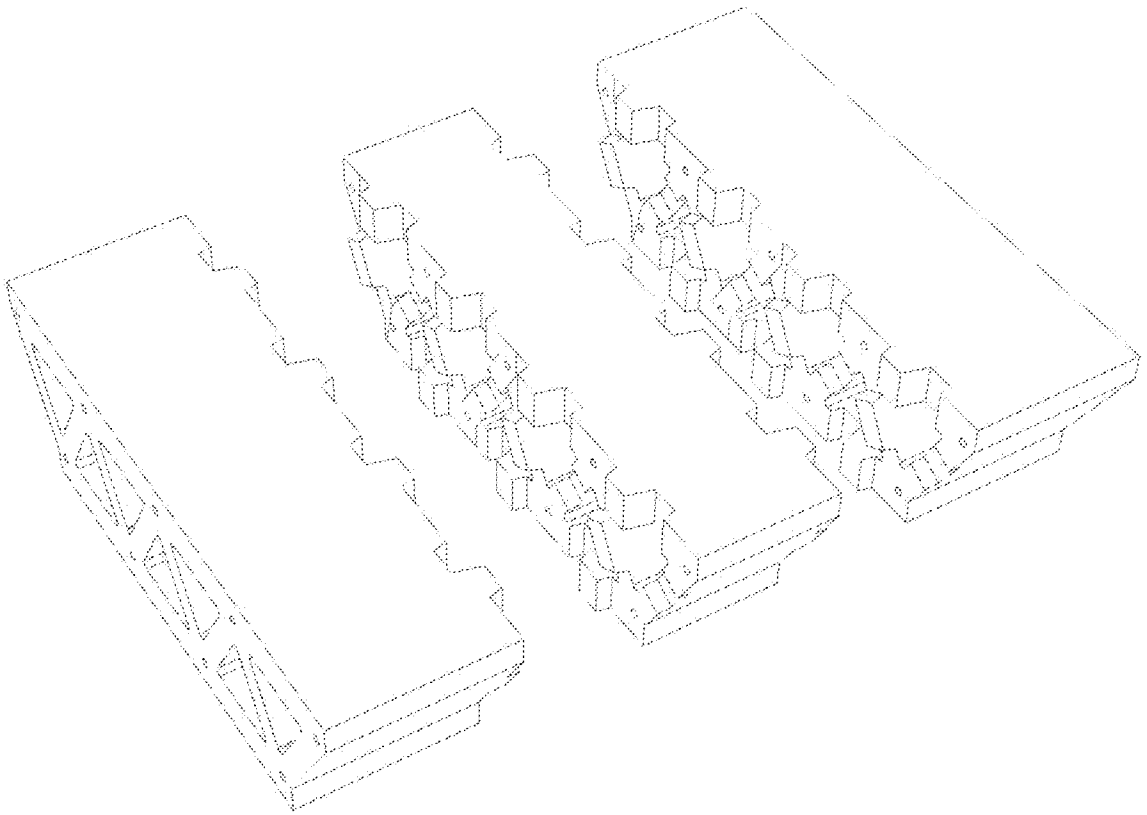

FIG. 5 (collectively including FIGS. 5A-5C) shows conceptual drawings of other example building blocks, related components and structures, and other related elements.

FIG. 5A shows views of example alternative wall blocks and related structures. These example alternative wall blocks and related structures include similar elements and are used similarly to the wall blocks and related structures primarily described herein.

Alternative wall blocks and related structures include a set of template blocks 510 that are laid on a foundation and form a regular pattern onto which other blocks can be set. The template blocks 510 are flat on their bottoms and top, and include the triangular forms of the building blocks 100, so as to guide and position the disposition of those blocks 100.

Base blocks 520 are similar to building blocks 100, but lack protrusions/recesses on the bottom. This has the effect that the base blocks 520 can be disposed on top of the template blocks 510 without needing protrusions/recesses into which to fit.

Building blocks 100 can be disposed on top of base blocks 520. As further described herein, blocks 100 can be disposed in a "stacked bond" formation, in which each block 100 is placed on top of a corresponding block 100, or in a "running bond" formation, in which each block 100 is placed on top of multiple lower blocks 100, at an offset, as further described herein.

Building blocks 100 can be rotated 180 degrees in an X-Y plane (a horizontal plane); their protrusions/recesses will still fit together.

Alternatively, blocks 100 can be made trapezoidal in shape, that is, without stepped end conditions. In such cases, the trapezoidal blocks 100 can be disposed in the X-Y plane, that is, horizontally, with support struts, such as shown in FIGS. 1D-1E. Trapezoidal blocks 100 can also form a raised floor or a raised roof, as shown in FIGS. 1D-1E.

FIG. 5B shows views of example alternative wall blocks, corner blocks, and related structures. These example alternative wall blocks, corner blocks, and related structures include similar elements and are used similarly to the wall blocks, corner blocks, and related structures primarily described herein. These example alternative blocks can also be assembled to provide either (1) ends of walls, or (2) edges of openings, when combining blocks with blocks.

FIG. 5C shows other views of example alternative sloped roof blocks, related components and structures, and other related elements. These example alternative sloped roof blocks, related components and structures, and other related elements include similar elements and are used similarly to the sloped roof blocks, related components and structures, and other related elements primarily described herein. The view of these blocks can be either obliquely from below, as shown in FIGS. 4A-4D, or obliquely from above. These blocks can work in either orientation; they would just have different support structures.

Alternative Embodiments

Although this application is primarily described with respect to architectural building structures, in the context of the invention, there is no particular requirement therefor. Techniques described herein have broad applicability to other constructed structures, whether macrostructures, microstructures, or in between. For example, the components, devices, or assemblies, can be used to construct home improvement projects, including children's playhouses or tree houses, enclosed patios, garden equipment and storage, guest houses and home extensions, outdoor kitchens and pool buildings, seasonal structures, or other micro-buildings. For another example, the components, devices, or assemblies, can be used to construct playhouses and other toys for children, scale models (including architectural scale models) that represent full-size structures. For another example, a builder, contractor, designer, or homeowner (or other interested party) can create a structure at a relatively small scale, determine what parts are needed to construct the full-size structure, and determine costs and other requirements for full-size construction. The modular blocks and associated devices, as further described herein, can be constructed at both small scales and large scales, and methods associated therewith are applicable to those scales.

The invention claimed is:

1. A modular structural building block, including a pair of outside walls separated by and enclosing an internal region;

a plurality of iterated interlocking equilateral triangular structures disposed between and coupled to each of the outside walls;

each triangular structure including one or more internal walls disposed between the outside walls and dividing the internal space into one or more internal subregions, the triangular structures alternating in opposite orientations;

each triangular structure including a first wall having a protrusion at a vertical offset above at least a portion of the outside walls, and including a second wall having a recess at a vertical offset depressed below at least a portion of the outside walls, the protrusions/recesses each being disposed on an internal wall and including a base having a vertical offset and a pair of sides slanted and rising/falling with respect to its internal wall, the protrusions/recesses alternating in orientation, the protrusions/recesses each being disposed at an acute angle with respect to the outside walls;

wherein the vertical offsets are disposed to match those of a second block, so that when the second block is disposed parallel to the outside walls the vertical offsets match those of the second block at the acute angle with respect to the outside walls and the landings match those of the second block;

whereby the block is disposed to fit into a rigid structure when its protrusions/recesses match that of the second block, wherein the protrusions/recesses are disposed so that rotations about the block about at least two axes still allow the protrusions/recesses to fit together with at most one rotation of one said block.

2. A block as in claim 1, wherein the internal walls have the same width as the outside walls;

the protrusions/recesses have the same width as the internal walls.

3. A block as in claim 1, wherein the protrusions/recesses are disposed so as to match those of the second block;

the protrusions/recesses are disposed so that when the second block is disposed at a selected offset parallel to the outside walls, the vertical offsets match those of the second block at the same acute angle with respect to the outside walls;

the selected offset being defined by a size of the triangular structures.

4. A block as in claim 1, wherein an angle at which the protrusions/recesses are disposed matches the angle formed between the internal walls and the outside walls.

5. A block as in claim 1, including a first partial-height wall at a first end of the block, the first partial-height wall being coupled between and including at least a portion of an outside wall, the first partial-height wall being disposed with a top having a first vertical offset at a portion of the top of an outside wall and with a bottom having a vertical offset at a portion between the bottom and the top of an outside wall;

a second partial-height wall at a second end of the block, the second partial-height wall being coupled between and including at least a portion of an outside wall, the second partial-height wall being disposed with a bottom having a vertical offset at a portion of the bottom of an outside wall and with a top having a second vertical offset at a portion between the top and the bottom of an outside wall;

wherein the first/second partial-height walls are disposed to match those of a second block when the second block is disposed in a line with the outside walls the first/second vertical offsets match those of the second block.

6. A block as in claim 5, wherein the first/second partial-height walls have the same width as the outside walls.

7. A block as in claim 5, including one or more holes disposed in the first/second partial-height walls, the holes disposed so as to be aligned when the first/second partial-height walls are disposed to match those of a second block;

wherein the holes are disposed in the first/second partial-height walls being disposed in a hexagonal/triangular grid when located at ends of the first/second partial-height walls.

8. A block as in claim 1, including one or more landings disposed where the internal walls and the outside walls intersect, each outside wall including a second protrusion at a vertical offset above at least a portion of the outside wall, and including a second recess at a vertical offset below at least a portion of the outside wall, the second protrusions/recesses each being disposed parallel to the outside walls;

wherein the vertical offsets are disposed to match those of a second block, wherein when the second block is disposed parallel to the outside walls the vertical offsets match those of the second block at the parallel angle with respect to the outside walls;

whereby a block fits into a rigid structure when its protrusions/recesses match that of the second block, wherein the protrusions/recesses are disposed so that rotations about the block about at least two axes still allow the protrusions/recesses to fit together with at most one rotation of one said block.

9. A block as in claim 8, wherein the second protrusions/recesses are disposed on the outside walls between the landings, with at least one second protrusion and at least one second recess disposed between each pair of landings.

10. A block as in claim 8, wherein the second protrusions/recesses are disposed so as to match those of the second block;

when the second block is disposed at a selected offset parallel to the outside walls the vertical offsets match those of the second block at the same acute angle with respect to the outside walls;

the selected offset being defined by a size of the triangular structures.

11. A block as in claim 8, wherein the second protrusions/recesses have the same width as the outside walls.

12. A block as in claim 1, wherein a top portion of the block is disposed at a first angle with respect to a bottom portion of the block;

the top and bottom portions being disposed so that when a second block is disposed parallel to the outside walls of the block, the block and the second block form a second angle with respect to the top portion of the combination thereof and the bottom portion of the combination thereof;

the top and bottom portions being disposed so that when a set of blocks is disposed parallel to the outside walls of the block, the set of blocks forms a structure curved about a vertical radius of curvature, whereby the structure is disposed as a vault above a defined area, the set of blocks being rigidly couplable with respect to the protrusions/recesses.

13. A block as in claim 12, wherein the first angle between the top portion of the block and the bottom portion of the block is selected by an amount of a center wedge of the block that is excluded.

14. A block as in claim 1, wherein a first outside wall of the block is curved with respect to a second outside wall of the block, the curve being selected by an amount of a wedge of the block that is excluded from the first outside wall;

the first and second outside wall being disposed so that when a second block is disposed parallel to the outside walls of the block, the block and the second block form a portion of a horizontal circle or ellipse with respect to the inside/outside walls of the combination thereof;

the first and second outside wall being disposed so that when a set of blocks forms a horizontal circle or ellipse with respect to the inside/outside walls of the combination thereof, the vertical offsets are disposed to match a set of protrusions/recesses of a plurality of triangular structures at an angle with respect to the outside walls, the angle being responsive to the amount of the wedge that is excluded;

whereby when one or more blocks are disposed on top of the set of blocks forming the horizontal circle or ellipse, the one or more blocks are conformed to a rigid structure in response to alignment of the matching vertical offsets.

15. A block as in claim 1, wherein a first outside wall of the block is curved with respect to a second outside wall of the block, the curve being selected by an amount of a wedge of the block that is excluded from the first outside wall;

the first and second outside wall being disposed so that when a second block is disposed parallel to the outside walls of the block, the block and the second block form a portion of a horizontal circle or ellipse with respect to the inside/outside walls of the combination thereof;

the first and second outside wall being disposed so that when a set of blocks forms a horizontal circle or ellipse with respect to the inside/outside walls of the combination thereof, the vertical offsets are disposed to match a set of second protrusions/recesses along the outside walls;

whereby when one or more blocks are disposed on top of the set of blocks forming the horizontal circle or ellipse, the one or more blocks are conformed to a rigid structure in response to alignment of the matching vertical offsets.

16. A block as in claim 1, wherein a first outside wall of the block is curved with respect to a second outside wall of the block, the curve being selected by an amount of a wedge of the block that is excluded;

the first and second outside wall being disposed so that when a second block is disposed parallel to the outside walls of the block, the block and the second block form a portion of a horizontal circle or ellipse with respect to the inside/outside walls of the combination thereof;

the first and second outside wall being disposed so that when a set of blocks forms a horizontal circle or ellipse with respect to the inside/outside walls of the combination thereof, the vertical offsets are disposed to match a set of protrusions/recesses of triangular structures, at acute angles with respect to the outside walls;

whereby blocks disposed on top of the set of blocks forming the horizontal circle or ellipse are conformed to a rigid structure in response to alignment of the matching vertical offsets.

17. A structure, including a plurality of modular structural building blocks as set forth in claim 1, wherein the structure includes a set of struts disposed to orient the structure.

18. A structure as in claim 17, wherein the plurality of modular structural building blocks includes one or more vault blocks, each with a first side disposed in a plane at an angle from a second side, the first and second sides being disposed to impose a slight curve in the structure;

wherein when assembled, the blocks are disposed to form an arch.

19. A structure as in claim 17, wherein the plurality of modular structural building blocks includes one or more tank blocks, each with the first wall having a different length than the second wall;

wherein when assembled, the blocks are disposed in a curved shape to create a tank structure.

20. A block as in claim 1, wherein a first outside wall of the block is curved with respect to a second outside wall of the block, the curve being selected by an amount of a wedge of the block that is excluded;

the first and second outside wall being disposed so that when a second block is disposed parallel to the outside walls of the block, the block and the second block form a portion of a horizontal circle or ellipse with respect to the inside/outside walls of the combination thereof;

the first and second outside wall being disposed so that when a set of blocks forms a horizontal circle or ellipse with respect to the inside/outside walls of the combination thereof, the vertical offsets are disposed to match when the blocks are disposed at selected offsets along the outside walls;

whereby when one or more blocks are disposed on top of the set of blocks forming the horizontal circle or ellipse, the one or more blocks are conformed to a rigid structure in response to alignment of the matching vertical offsets.

* * * * *